US010401117B1

(12) United States Patent
Rowzie, Jr. et al.

(10) Patent No.: US 10,401,117 B1
(45) Date of Patent: Sep. 3, 2019

(54) ANTI-DRY FIRE KEYWAY TRIGGER SYSTEM FOR CROSSBOWS

(71) Applicant: Parker Compound Bows, Inc., Staunton, VA (US)

(72) Inventors: Guy Hamilton Rowzie, Jr., Staunton, VA (US); Robert Morris Mason, Fishersville, VA (US)

(73) Assignee: Parker Compound Bows, Inc., Staunton, VA (US)

( * ) Notice: Subject to any disclaimer, the term of this patent is extended or adjusted under 35 U.S.C. 154(b) by 0 days.

(21) Appl. No.: 16/039,548

(22) Filed: Jul. 19, 2018

(51) Int. Cl.
*F41B 5/12* (2006.01)

(52) U.S. Cl.
CPC ..... *F41B 5/12* (2013.01); *F41B 5/123* (2013.01)

(58) Field of Classification Search
CPC ..... F41B 5/12; F42B 6/06
See application file for complete search history.

(56) References Cited

U.S. PATENT DOCUMENTS 3,128,570 A 4/1964 Browning
3,658,335 A 4/1972 Saunders
4,234,192 A * 11/1980 Salamone ..... F42B 6/06 473/586
4,305,588 A 12/1981 Dodge
4,502,692 A * 3/1985 Humphrey ..... F42B 6/06 473/586
4,615,552 A * 10/1986 Bengtson ..... F42B 6/06 244/3.24
4,645,211 A 2/1987 Beitner
4,877,008 A 10/1989 Troubridge
5,085,200 A 2/1992 Horton-Corcoran et al.
5,154,432 A 10/1992 Saunders
5,306,020 A 4/1994 Bolf
5,465,979 A 11/1995 Buhler
5,584,614 A 12/1996 Aidlin et al.
5,598,829 A 2/1997 Bednar
5,649,520 A 7/1997 Bednar
5,884,614 A * 3/1999 Darlington ..... F41B 5/12 124/25

(Continued)

OTHER PUBLICATIONS

Silk, Jon E., "Technical Crossbow Test." Petersen's Bowhunting, vol. 29, Issue 3, Jun. 2018, pp. 58-59. Outdoor Sportsman Group Publication, New York, NY USA. (3 pages total incl. cover).

*Primary Examiner* — John A Ricci
(74) *Attorney, Agent, or Firm* — Daniel L. Fitch, Esq.; Ginger T. Chapman, Esq.

(57) ABSTRACT

A Keyway Trigger System with a dry fire prevention nock is provided for use in a crossbow. The System ensures proper, full engagement of the dry fire prevention nock with a crossbow string such that the crossbow will only fire when an arrow is loaded correctly. The nock is received in a slotted opening forming a keyway adapted to be engaged by surfaces of the profiled dry fire prevention nock such that only when an arrow is properly loaded into the keyway, aligned with trigger latch members and fully engaged with the crossbow string then the trigger moves from a non-firing position to a firing position allowing the arrow to be fired. The Keyway Trigger System prevents dry fire and partial dry fire, eliminates risk of damage to the crossbow, eliminates potential risk of injury to a user, and improves accuracy and reliability of the flight trajectory of the arrow.

15 Claims, 19 Drawing Sheets

(56) References Cited

U.S. PATENT DOCUMENTS

| | | | | |
|---|---|---|---|---|
| 6,017,284 | A * | 1/2000 | Giles | F42B 6/06 473/578 |
| 6,736,123 | B1 * | 5/2004 | Summers | F41A 17/46 124/25 |
| 7,189,170 | B1 | 3/2007 | Korsa et al. | |
| 7,770,567 | B1 | 8/2010 | Yehle | |
| 7,814,894 | B2 | 10/2010 | Giroux | |
| 8,091,540 | B2 | 1/2012 | Matasic et al. | |
| 8,622,855 | B2 | 1/2014 | Bednar et al. | |
| 8,899,218 | B2 | 12/2014 | Kempf | |
| 8,931,465 | B1 | 1/2015 | Choma | |
| 9,004,053 | B1 * | 4/2015 | Anderson | F41B 5/1469 124/31 |
| 9,010,308 | B1 | 4/2015 | Hyde et al. | |
| 9,140,527 | B2 | 9/2015 | Pedersen et al. | |
| 9,255,754 | B1 * | 2/2016 | Kempf | F41B 5/12 |
| 9,285,195 | B1 | 3/2016 | Palomaki et al. | |
| 9,435,605 | B2 | 9/2016 | McPherson et al. | |
| 9,494,380 | B1 | 11/2016 | Yehle | |
| 9,506,715 | B2 | 11/2016 | Hughes | |
| 9,551,544 | B1 | 1/2017 | Kempf | |
| 9,631,909 | B2 | 4/2017 | Boretto et al. | |
| 9,689,638 | B1 | 6/2017 | Yehle | |
| 2009/0194086 | A1 | 8/2009 | Kempf | |
| 2016/0195374 | A1 | 7/2016 | Pedersen | |
| 2017/0010082 | A1 | 1/2017 | Bednar | |

* cited by examiner

ANTI-DRY FIRE KEYWAY TRIGGER SYSTEM FOR CROSSBOWS

CROSS-REFERENCE TO RELATED PATENT APPLICATIONS

None

STATEMENT REGARDING FEDERALLY SPONSORED RESEARCH OR DEVELOPMENT

None

BACKGROUND OF INVENTION

Field of Invention

The present disclosure is directed towards an anti-dry fire system for use with crossbows. More particularly, the present invention is an anti-dry fire Keyway Trigger System used for proper alignment and engagement of arrows that are fired from crossbows to prevent the likelihood of dry fire and partial dry fire of a cocked crossbow.

Related Art

Crossbows have been used for many years as a weapon for hunting, fishing, and shooting sports. Crossbows exist in different variants but essentially comprise a bow mounted on an elongate frame, termed a stock, with a built in mechanism that holds a drawn bow string and with a trigger mechanism that allows the string to be released to launch a loaded projectile.

Crossbows shoot fin-stabilized projectiles, termed "arrows", or "bolts". Arrows generally include a straight shaft, a weighty projectile tip, point, or arrowhead formed or mounted at the forward-most tip of the shaft, with flight-stabilizing vanes or fletching provided proximate a rearward end portion of the shaft, and a grooved, notched, or "nocked" rearmost end of the shaft. The term "bolt" is often used interchangeably with "arrow" to describe a crossbow projectile; however, a crossbow bolt does not have vanes or fletching, while a crossbow arrow is fletched and is typically a shortened arrow to fit the crossbow's shorter powerstroke, i.e. the distance the crossbow string travels along the longitudinal axis of the rail of the crossbow from a fully uncocked position to a cocked position. Arrows may be used without fletching, i.e. bare shafts are used for training purposes because their flight renders errors made by archers and arbalists more visible. Traditional arrow shafts may be made from strong, lightweight wood, bamboo, reeds, or two or more types of wood fastened together to form footed shafts, while modern shafts may be manufactured from aluminum, carbon fiber, reinforced plastic, or a combination of materials. Fletching is attached proximate the rearward end of the arrow to act as airfoils thereby stabilizing the arrow while in flight. Fletching aerodynamically stabilizes an arrow by imparting a natural spin on the arrow and keeping it pointed in the direction of flight by dampening pitch or yaw. Fletching refers collectively to feathers, vanes, or fins, each of which is individually termed a fletch. Traditionally, three vanes or matched half-feathers are equally spaced about the arrow's circumference to allow for stabilization in flight. Four or more fletches have been used historically and for specialized arrows. Vanes are fletches generally fabricated from durable polymers such as soft, flexible plastic, or natural or synthetic rubber-based elastomers; hence, vanes are quiet in flight. Vanes may be parabolic in shape or formed in a shield shape. Vanes are positioned on the shaft in straight, offset, or helical arrangements. Vanes may be set at a slight angle, termed an offset fletch, or set into a twist, termed a helical fletch, to create the same effect as the natural curve of feathers, that is, to impart stability to the arrow to ensure the arrow does not tumble during flight. Conventional three-vane fletching provides one visibly differently colored reference vane, termed a cock vane, set at approximately a right angle to the nock groove, and the arrow is nocked so that the cock vane will not contact the crossbow when the arrow is shot. Thus the cock vane provides a visible reference signal that the arrow is properly aligned with respect to the crossbow string. Nocks are the rearmost portion of an arrow and the only part of the arrow that properly comes into contact with the crossbow string to receive the force imparted thereby. Nocks typically are provided in one of two forms: flat nocks or moon nocks. Nocks help archers properly position an arrow to maximize the energy, speed, range, and power of the arrow's flight trajectory.

Modern crossbow designs have increased the force with which arrows are shot or fired by increasing the stiffness of the bow limbs. Increasing the stiffness of the bow limbs enhances the potential energy storage capacity of modern crossbows. The increased stiffness of the bow limbs requires the application of significant force to draw and cock a crossbow string into a trigger mechanism prior to loading an arrow into the crossbow for firing.

Trigger mechanisms, as known in the art, were developed in order both to hold the crossbow string in a drawn positon and to release the string when the trigger is operated. Trigger assemblies generally include a crossbow string catch which holds the crossbow string in a cocked position until the trigger is manipulated. Trigger mechanisms enable the drawn crossbow string to be retained with high tension for maximum propulsive force to launch a loaded arrow when the trigger is pulled. The stored energy within the bow is transferred to the arrow in the form of kinetic energy when the arrow is shot or fired from the crossbow.

Trigger assemblies generally include a safety component. Automatic safety devices are automatically set upon drawing the crossbow string into the trigger mechanism. Conventional on/off safety devices are manipulated by a user to permit or prevent firing of an arrow. Such conventional on/off safety devices act directly on the trigger without regard for whether or not an arrow has been loaded into the crossbow.

Moreover, conventional on/off safety levers do not prevent "dry firing" or "dry fires", that is, the release of a drawn crossbow string when there is no arrow is loaded into the crossbow. It is well known, however, that dry firing can cause severe damage to the crossbow and crossbow limbs; therefore, prevention of dry fires is highly desirable.

Although some proposed solutions have been attempted to prevent dry fires when no arrow is loaded in a crossbow, few or limited attempts have been made to prevent "partial dry fires". Partial dry fires occur when an arrow is incorrectly loaded and fired, likewise resulting in severe damage to the crossbow, limbs, and other components. A properly loaded and aligned arrow is fully seated against and fully engages with the crossbow string both when fully cocked and upon firing of the cocked crossbow. Therefore ensuring proper loading, alignment, and full engagement of the arrow nock with the crossbow string is crucial in preventing dry fires and partial dry fires.

As a general practice, nocks are used to seat an arrow on the bowstring of a cocked crossbow until the arrow is shot or fired. Nocks are provided at the rearmost end of the arrow shaft and may be integral or made as a separate component that is affixed to the rearward end of the shaft. Nocks help an archer or hunter align the arrow to the crossbow string during loading of the crossbow. The nocked end engages and seats the string until the crossbow trigger is pulled thus releasing the string and firing the arrow. Improperly aligned nocks prevent proper contact between the nock and the crossbow string, thereby affecting the accuracy and reliability of the arrow's speed and trajectory. Safe operation of a crossbow requires that the nock make full engagement with the crossbow string.

After spanning and cocking a crossbow string, the archer indexes the vanes of the arrow into proper orientation with the crossbow string in order to efficiently transfer the stored energy in the bow limbs to the arrow. The cock vane must be aligned within the flight groove in the barrel of the crossbow and the nock aligned with the string. When the arrow is placed properly on the crossbow with the cock vane down in the flight groove, the vane does not contact the sides of the groove and the nock is line with the string. When the crossbow string is released the nock keeps the string aligned directly with the longitudinal axis of the arrow. The energy of the crossbow string is therefore efficiently and properly transferred to the arrow resulting in straight and true arrow flight trajectory. However, when the arrow is misaligned then the nock will not seat against the string, thereby causing a partial dry fire.

Safe and accurate shooting requires an archer to control the orientation, indexing, alignment and engagement of a nock to properly seat the arrow against the crossbow string each and every time an arrow is fired from the crossbow. Consistent performance is difficult during the rigor of field conditions such that many arrows are inadvertently misfired due to incorrect loading. A mistake as simple as loading the wrong vane or fletch point downward in the flight groove misaligns the arrow and causes an asymmetrical impact against the nock thereby imparting a rotational or lateral deflection, or deviation to the arrow's release and catching its fletching on the crossbow barrel or rail.

Additionally, improperly aligned arrows cause significant safety problems when the crossbow is fired. When the rearward portion of an arrow is incorrectly aligned with the nock or the flight groove, the crossbow string is released without launching the arrow, resulting in dry firing of the crossbow and severe damage to the crossbow components. Moreover, improper engagement between a misaligned arrow's nock against the crossbow string can leave a gap or separation between the nock and the string. Any gap between the nock and the crossbow string causes the string, when released, to slap against the rear surface of the nock in an irregular manner. This impact causes the crossbow string to jump over or slide under the nock and travel along the length of the arrow shaft during launching of the arrow. This irregular transfer of energy to the rear of the arrow during its launch results in a partial dry fire and subsequent severe damage to the crossbow, crossbow limbs, and other components thereof.

As discussed above, when a dry fire or a partial dry fire occurs, the potential energy stored in the crossbow limbs is not properly transferred as kinetic energy to the arrow. The stored energy that would normally be transferred to the arrow is instead transmitted to and absorbed by various components of the crossbow. A single dry fire incident can cause fracture to and breakage of the crossbow limbs and other components and also potentially cause injury to the user.

Most knowledgeable archers understand the inherent dangers of dry firing crossbows. However, it is not uncommon to inadvertently cause a crossbow dry fire by improper loading of an arrow even when conscious of the dangers. Dry fires occur frequently and can happen to any archer whether beginner or expert. For example, hunters distracted by their quarry commonly misalign the arrow nock with the cocked crossbow string, increasing the likelihood of a dry fire. Whether from inexperience, distractions or inadvertent misfire or release of an arrow, any crossbow that has been dry fired must be thoroughly inspected for damage before any further use. Any crossbow limbs that are fractured, cracked, or splintered must be replaced before the crossbow is able to be fired again. Replacing damaged crossbow components, especially damaged limbs, create a significant liability to crossbow manufacturers who often warrant their product for extended periods. Because dry fires are costly and time intensive to remediate, preventing their occurrence is of primary importance to archers and the industry.

Much effort has been undertaken to prevent such occurrences. Many attempted solutions have tried safety levers that lock triggers in a non-firing position when there is no arrow loaded in the crossbow, but this has not sufficiently addressed the needs of the industry owing to its limited applicability. Such a solution does nothing to prevent a dry fire or partial dry fire caused by a misaligned arrow nock.

Some attempted solutions, such as U.S. Pat. No. 9,689,638 B1 discloses a trigger assembly contained in a string carrier that slides along a center rail to provide a lighter trigger pull with an anti-dry fire lock out for a clip-on nock but this has not sufficiently addressed the needs of the industry due to its complexity. U.S. Pat. No. 9,506,715 B2, discloses arrangements of trigger assemblies including safety mechanisms for use in crossbows. The '715 trigger assembly includes a floating sear that is able to translate with a cable catch as the cable catch is rotated and also may rotate relative to the cable catch; as the cable catch moves from an uncocked position to a cocked position, the floating sear engages a pivot beam that is engaged with a trigger mechanism. As the cable catch is cocked and a user pulls the trigger, a trigger roller rotates into contact with the pivot beam which rotates, drops, and loses contact with the floating sear creating clearance between the pivot beam and the floating sear. The cable catch is then free to rotate and release the bowstring held in the catch to fire an arrow.

U.S. Pat. No. 6,736,123 B1 discloses a trigger mechanism including a trigger housing, a pivotably mounted jaw component and a dry fire prevention lever pivotably mounted on the jaw component and arranged to engage a stop when no arrow is loaded in the crossbow and a surface portion that moves away from the stop to permit movement of the jaw component when an arrow is loaded into the crossbow.

All of the foregoing attempts, while laudable, suffer from limitations. One drawback of these attempted solutions is that while acting directly on the trigger; none prevent dry fires when there is no arrow loaded, or either dry fires or partial dry fires when an arrow is loaded but is improperly loaded. Neither do these inventions prevent dry fires and partial dry fires when an arrow is improperly oriented, incorrectly indexed, or is misaligned such that its nock is not in full engagement with and seated against the cocked crossbow string.

By comparison, little or no attention has been afforded to providing a trigger that ensures proper orientation, alignment, and engagement of arrow nocks in order to prevent dry firing and partial dry firing of arrows. As previously discussed, improperly aligned arrows cause of dry fires and partial dry fires that are a significant safety problem resulting in serious damage to crossbows and potential injury to archers and hunters. Therefore ensuring proper loading of arrows is paramount, and the present invention effectively eliminates the probability of dry fires and partial dry fires, thereby eliminating the risk of damage to crossbows and risk of injury to users and bystanders.

An additional benefit of the present invention is the improved accuracy and reliability of arrow flight trajectories resulting from a properly loaded and fully engaged arrow nock ensuring true arrow flight every time with every shot. Additional advantages and benefits of the present claimed invention will become apparent in the disclosure.

SUMMARY OF THE INVENTION

The invention is in general directed to a novel design for an anti-dry fire trigger system for use with crossbows. The present claimed invention will provide for an anti-dry fire Keyway Trigger System in the field of crossbow archery. As a general embodiment, the present disclosure is directed to a trigger assembly including interacting components defining a keyway opening that receives a dry fire prevention nock. The dry fire prevention nock operatively interacts with portions of the trigger assembly forming an anti-dry fire mechanism including a prong portion located in parallel alignment with crossbow string catch prongs of a trigger latch. The system provides an anti-dry fire keyway system and a dry fire prevention nock and for alignment and engagement of arrows that are fired from crossbows to effectively eliminate the possibility of dry fire and partial dry fire when an arrow is loaded or improperly loaded into a crossbow. The anti-dry fire Keyway Trigger System will greatly increase the ability of archers and hunters to improve the accuracy and reliability of firing and true flight trajectory of their arrows.

One embodiment of the claimed inventive system is directed to an anti-dry fire trigger assembly and a dry fire prevention nock for use with a crossbow. The system includes a profiled arrow nock design configured to correspond to a slotted opening in the trigger assembly. The anti-dry fire system is actuated as the profiled arrow nock is slidably inserted into and through the slotted opening formed in an arrow loading area of the trigger assembly. The opening is defined by a trigger latch component and an anti-dry fire component. The trigger latch component is moveable between a first, string-retaining position and a second, string-releasing position; and the anti-dry fire mechanism is moveable between a first, locked position and a second, unlocked position. The operation of the trigger system requires that the dry fire prevention nock be pushed all the way back into the trigger assembly making full engagement with the crossbow string. The profile of the dry fire prevention nock is fashioned so as to be inserted into the slotted opening similar to the insertion of a key into a keyway. As the profiled arrow nock design is inserted into the trigger assembly arrow loading area it causes the trigger latch to move to its second, string-releasing position and the anti-dry fire mechanism to move to its second, unlocked position when the nock is seated against and fully engages the crossbow string. The configuration of the profiled arrow nock design allows proper loading and firing of an arrow thereby eliminating the risk of dry fires and partial dry fires of the crossbow. Conventional nocks, as further described, are not profiled properly and thus are not fully insertable in the slotted opening. Additionally, the dry fire prevention nock precludes the user from leaving a gap between the nock groove and the crossbow string thereby eliminating the risk of producing a dry fire or partial dry fire of the crossbow and eliminating the risk of damage to the crossbow and risk of injury to the user.

In one embodiment of the claimed invention in accordance with the present disclosure, a trigger latch mechanism moveable between a string-retaining position and a string-releasing position is formed with an opening that prevents conventional nocks from entering the trigger latch thereby eliminating the risk that an arrow will be incorrectly loaded in the crossbow and hence, preventing the occurrence of dry fires and partial dry fires. Such conventional nocks include; but are not limited to, flat nocks, moon nocks, and half-moon nocks. The trigger latch mechanism includes a component that engages an anti-dry fire mechanism at an interface as the anti-dry fire mechanism is moved to an unlocked position when the dry fire prevention nock fully engages with the crossbow string. If the nock is not fully engaged, then the anti-dry fire mechanism will not move to its unlocked position and the trigger will not release to fire the crossbow, thereby eliminating the risk of dry fires and partial dry fires of the crossbow.

In one embodiment of the claimed invention in accordance with the present disclosure, a safety mechanism includes a safe/fire safety lever moveable between a safe position and a fire position. A safety lever actuating link component engages the safety lever at an interface and is operatively coupled to the trigger latch mechanism. The safety lever has a side that is adapted and arranged to be flush to an inner side surface of the main body of the housing. The safety lever housing-facing side includes a first detent and a second detent. The inner surface of the housing located below the safety lever is formed with a ball bearing seat that receives a ball bearing therein. The safety lever is moveable from a first, safe position, where the ball bearing occupies the first detent, to a second, firing position, where the ball bearing occupies the second detent. When the ball bearing is in the first detent the safety lever is retained in the first, safe position. When the ball bearing is in the second detent, the safety lever is retained in the second, firing position. A trigger block attached to a trigger lever forms a trigger assembly component that is moveable between a first, non-firing position and a second, firing position. The safety lever blocks the trigger block from moving to the second, firing position when the safety lever is in the first, safe position. The trigger block operatively interacts with a sear that is moveable from a de-cocked position to a cocked position. The trigger latch mechanism includes a downwardly extending component that operatively interacts with the sear at an interface as the sear moves between the de-cocked position and the cocked position. The trigger latch mechanism engages with the sear at the interface as the trigger latch mechanism moves from the string-retaining position to the string-releasing position. The safety lever actuating link has a housing-facing side formed with a post that is received in a hole in the body of the trigger latch mechanism and couples the safety lever actuating link to the trigger latch mechanism. The trigger latch mechanism further includes a detainer component that operatively engages the anti-dry fire mechanism at an interface as the dry fire prevention nock moves the anti-dry fire mechanism from a first, locked position, to a second, unlocked position. The anti-dry fire mechanism and the trigger latch mechanism each include keyway opening components that interface with the dry fire prevention nock such that when the nock is fully inserted in the keyway opening and in full engagement with the crossbow string the anti-dry fire mechanism is caused to move from the first, locked position to the second, unlocked position and the trigger latch mechanism is thereby allowed to move from the first, string-retaining position, to the second, string-releasing position. The safe/fire safety lever is moveable from the safe position to the fire position, the sear is moveable from the de-cocked position to the cocked position and the trigger block is moveable from the first, non-firing position, to the second, firing position. When the dry fire prevention nock is fully inserted rearwardly into the arrow loading track, the arrow is in alignment, the cock vane is properly oriented in the fletch groove in the crossbow stock, the nock string groove is oriented at approximately 90 degrees to the cock vane on the arrow, and the nock string groove is in full engagement with the crossbow string. Only when the arrow nock is fully inserted such that it is pushed all the way rearwardly into the trigger assembly with the nock groove making full engagement with the crossbow string will the trigger assembly of the crossbow fire and release the crossbow string and launch the arrow when the trigger lever is pulled by a user.

The Keyway Trigger System enables a user to load an arrow correctly, completely and consistently every time in a manner which ensures proper alignment and engagement of the arrow nock to the crossbow string such that the crossbow will only fire when the arrow assembly is loaded correctly. In so doing, the Keyway Trigger System eliminates the possibility of the crossbow firing when an arrow nock is incorrectly oriented, not fully engaged or not of the proper profile to fit into the opening. When an arrow is loaded correctly into the opening, the nock is fully seated rearward against the crossbow string, indexed, aligned and fully engaged. The arrow may then be fired without the risk of dry fire or partial dry fire.

The present invention eliminates the possibility that a crossbow may be dry fired or partially dry fired thereby preventing significant damage and breakage to the bow assembly and its components and injury to the user. A bow assembly is usually understood to mean the front end of a crossbow, e.g. riser, bow limbs, wheels/cams and bowstrings. Illustration of various other conventional elements of a bow assembly is omitted to simplify presentation since they are not essential to comprehension of the present disclosure. The present invention further improves firing accuracy and consistency thereby yielding more precise arrow flight trajectory and improved accuracy. There is a long-standing and unmet need for a solution to this problem. The breakage of modern crossbows, which store substantial amounts of energy when cocked, as a result of dry fires and partial dry fires is widely known. The present disclosure may be easily adaptable to any crossbow stock.

The above summary of the present invention is not intended to describe each embodiment or every implementation of the present invention. The Drawings and the Detailed Description that follow more particularly exemplify a preferred embodiment. Objects, benefits and advantages pertaining to a trigger assembly for a crossbow may become apparent upon referring to the exemplary embodiments illustrated in the drawings and disclosed in the following written description or the appended claims.

Figure 1:
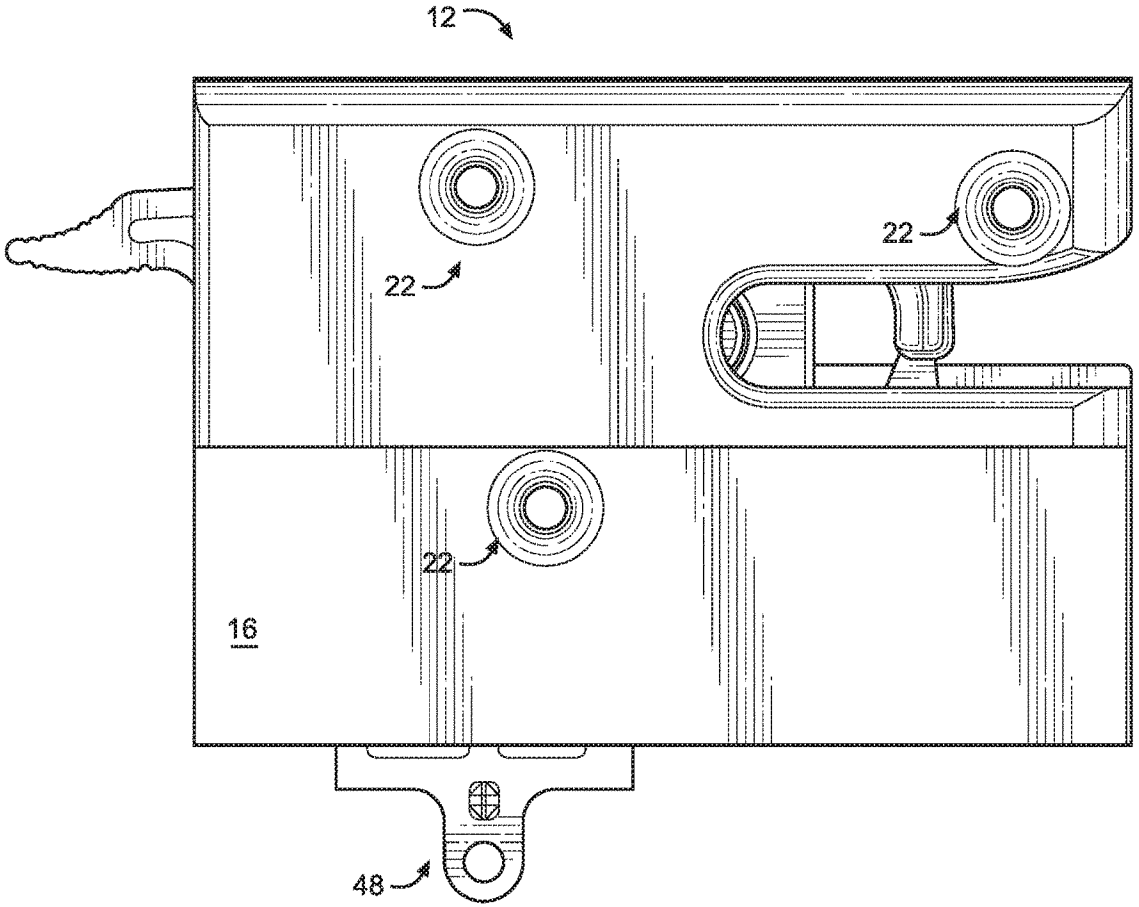
FIG. 1 is a side view of a trigger assembly housing with cover in a closed position.

The embodiments shown in the Figures are exemplary, and should not be construed as limiting the scope of the present disclosure and/or appended claims.

DETAILED DESCRIPTION OF THE INVENTION

For the purposes of promoting an understanding of the principles of the claimed invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. In the following description, for purposes of explanation, numerous specific details are set forth in order to provide a thorough understanding of the claimed subject matter. It may be evident, however, that the claimed subject matter may be practiced without these specific details. Referring now to the drawings wherein the showings are for purposes of illustrating embodiments of the invention only and not for purposes of limiting the same, and wherein like reference numbers are understood to refer to like components.

In the Detailed Description, various disclosed or claimed features are grouped together in a single disclosed exemplary embodiment for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of the single disclosed exemplary embodiment. Thus the appended claims are hereby incorporated into the Detailed Description, with each claim standing on its own as a separate disclosed exemplary embodiment. However the present disclosure shall also be construed as implicitly disclosing any embodiment having any suitable set of one or more disclosed or claimed features, i.e. sets of features that are not incompatible or mutually exclusive, that appear in the present disclosure or the appended claims, including those sets that may not be explicitly disclosed herein. It should be further noted that the scope of the appended claims does not necessarily encompass the whole of the subject matter disclosed herein.

FIGS. 1-25 illustrate schematically a crossbow Keyway Trigger System. The trigger system typically is mostly contained within an opening formed in a stock or rail of a crossbow (not shown) or can comprise a discrete housing that is in turn secured to a stock or rail of a crossbow. Those having skill in the art will understand that the term "rail" is used in a functional sense indicating a generally flat, smooth, elongated structural portion located topwardly of a crossbow fingergrip where an arrow is placed when the crossbow is loaded and a crossbow string slides across or therealong as the arrow is fired. Both arrangements are encompassed by the present disclosure. In the arrangement described herein, the crossbow is oriented such that the user places the proximal, stock end of the crossbow against his or her shoulder when firing the crossbow and the distal, front end is the part of the crossbow that faces the target. A foregrip located on the forward, distal, front part of the crossbow frame allows the aiming hand of the user a grasp to stabilize and control the crossbow while the user's firing hand grasps the trigger lever located proximally to the foregrip. The perspective of the user sighting down the rail when firing the crossbow is parallel to the longitudinal, central axis of the crossbow. The trigger assembly contained within the opening in the rail is oriented along a vertical plane passing through the longitudinal, central axis of the crossbow. The crossbow is not shown and may be of any suitable type or configuration as will be well known to one of skill in the art.

Figure 2:
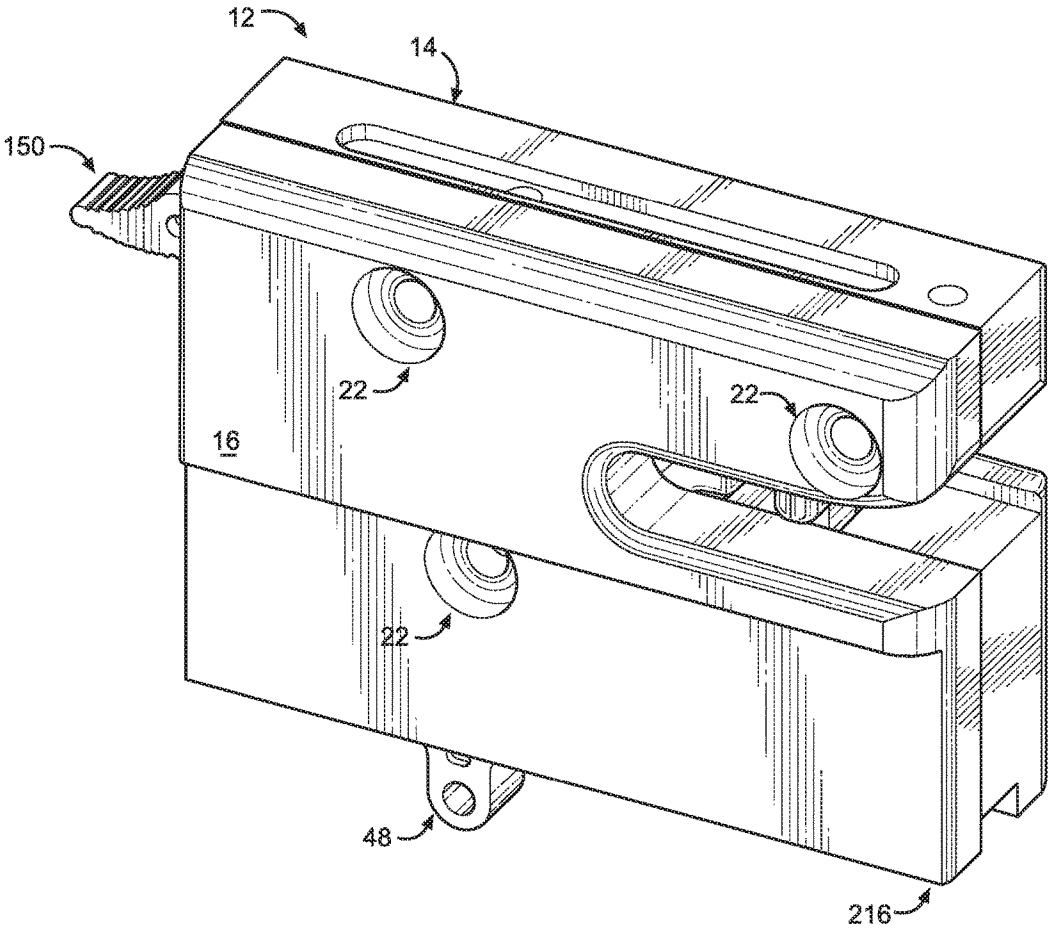
FIG. 2 is a perspective view of a trigger assembly housing main body with cover in a closed position.
Figure 11:
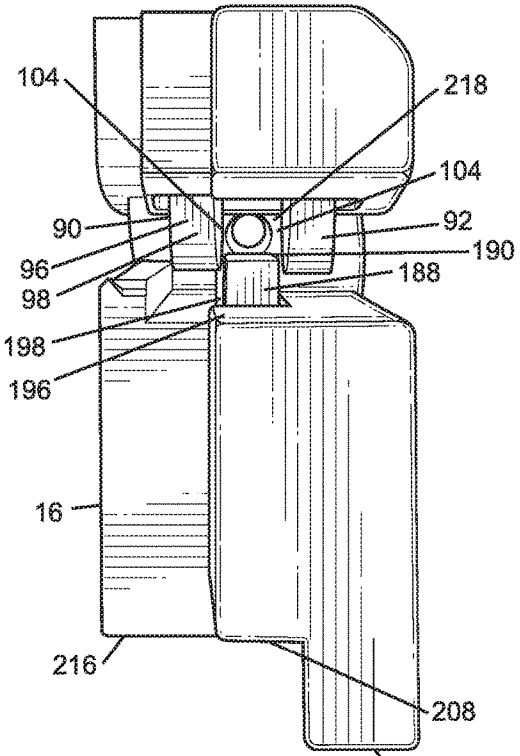
FIG. 11 is a front end view a trigger assembly of a Keyway Trigger System nock receiving opening and an anti-dry fire lever in an engaged position.
Figure 14:
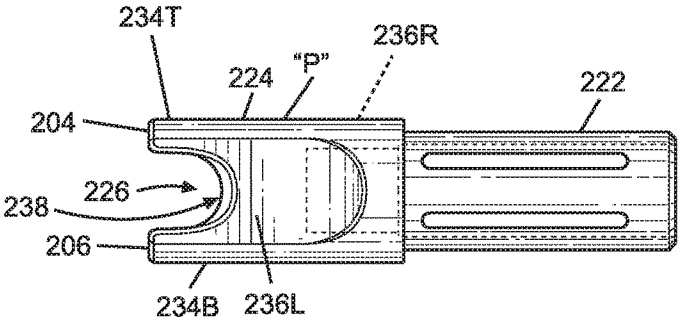
FIG. 14 is a side view of an arrow nock assembly including a profiled dry fire prevention nock in accordance with an embodiment of the present disclosure.
Figure 17:
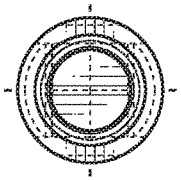
FIG. 17 is a front end view of a dry fire prevention arrow nock in accordance with an embodiment of the present disclosure.
Figure 16:
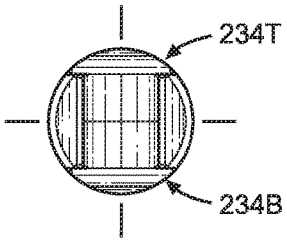
FIG. 16 is rear view of an arrow nock assembly including a profiled dry fire prevention nock in accordance with an embodiment of the present disclosure.
Figure 13:
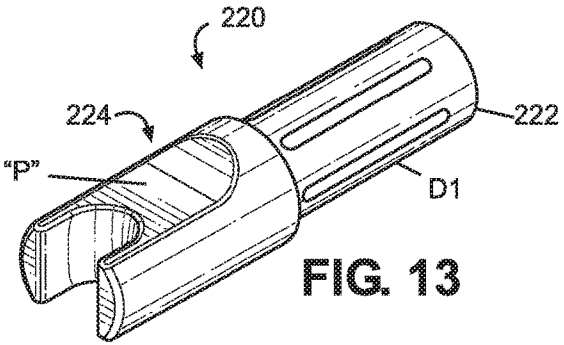
FIG. 13 is an isometric side view of an arrow nock assembly including a profiled dry fire prevention nock in accordance with an embodiment of the present disclosure.
Figure 15:
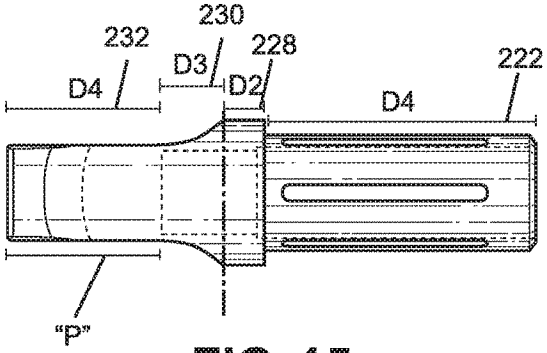
FIG. 15 is a top or bottom view of an arrow nock assembly including a dry fire prevention nock in accordance with an embodiment of the present disclosure.
Figure 22:
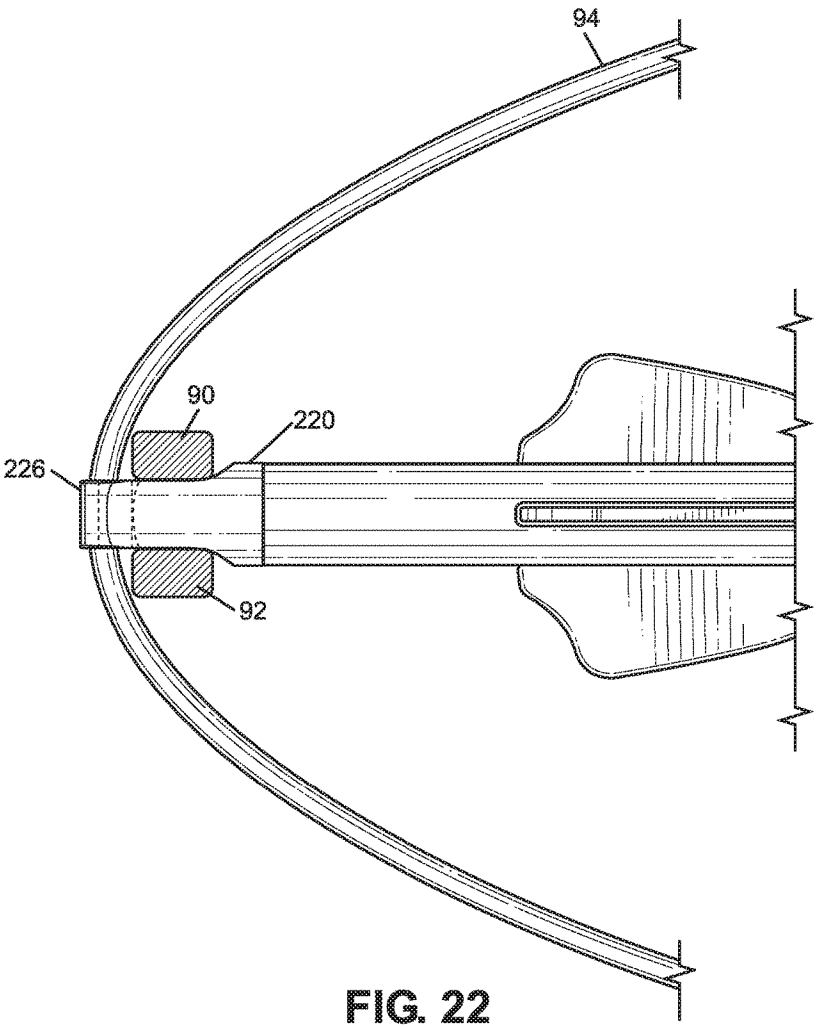
FIG. 22 is a bottom view of a dry fire prevention nock inserted into trigger latch prongs of a keyway opening in full engagement with a crossbow string.
Figure 23:
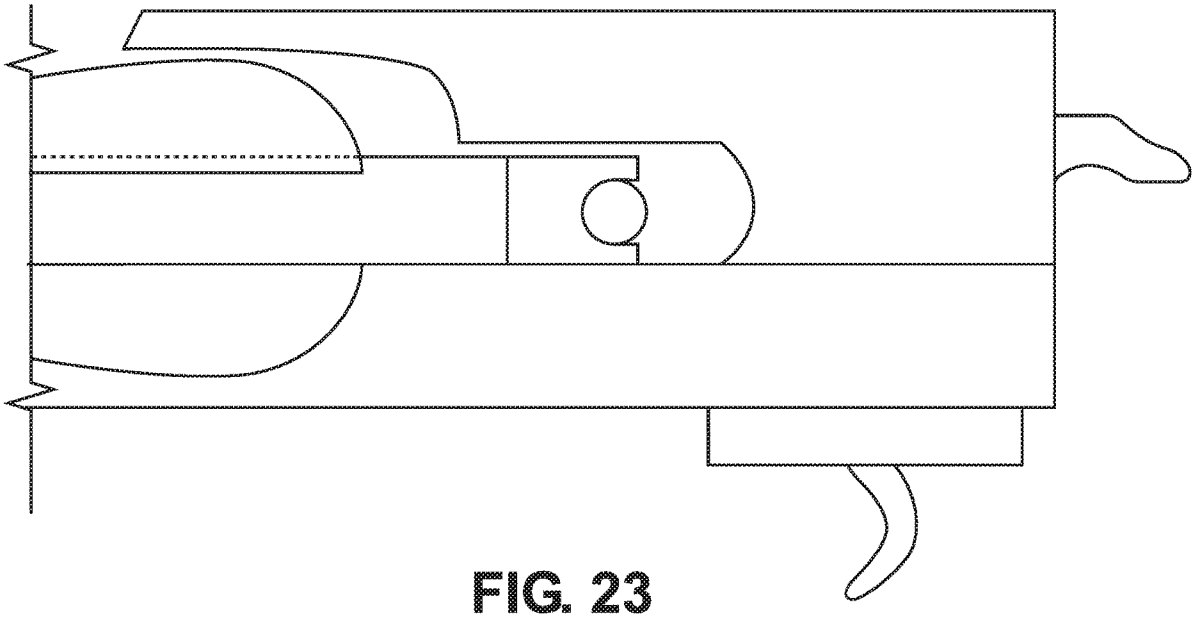
FIG. 23 is a side view of a proper engagement of a crossbow string against a groove of an arrow nock assembly in accordance with an embodiment of the present disclosure.
Figure 24:
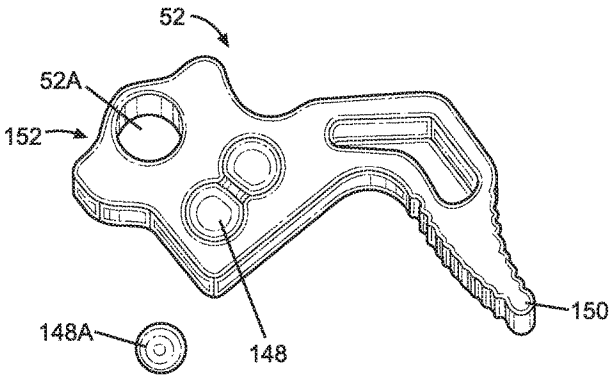
FIG. 24 is a bottom view of a housing facing surface of a fire/safe safety lever bearing seat and corresponding ball bearing in accordance with an embodiment of the present disclosure.
Figure 25:
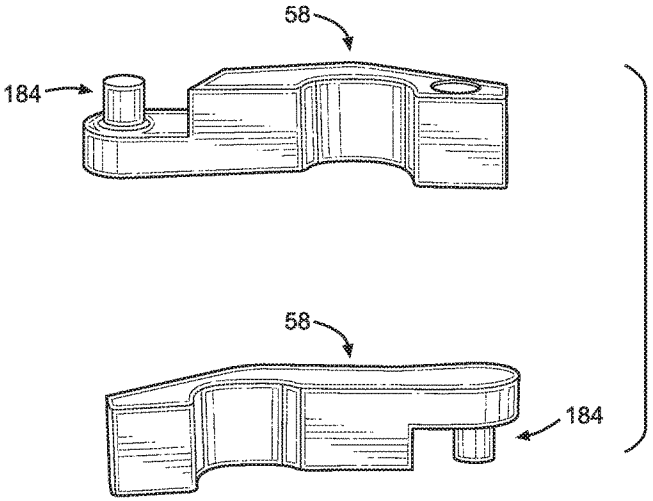
FIG. 25 is a bottom, right side view and a top, left side view of a housing facing surface of a safety lever actuating link having a post in accordance with an embodiment of the present disclosure.

In the Drawings the trigger assembly of the Keyway Trigger System is shown with the cover 16 side of the housing 12 in place in FIGS. 1, 2 and 11. The trigger assembly of the Keyway Trigger System is shown with the cover 16 removed in FIGS. 3-10 and 19-21 to reveal the trigger components therein. The trigger housing includes a plain and unornamented bottom; accordingly, a view of the bottom side is omitted. The entire trigger system is illustrated schematically in FIGS. 3-10, while FIG. 11 illustrates a keyway opening of the system; FIGS. 12-17 illustrate a dry fire prevention nock of the system; FIGS. 18-21 illustrate schematically a loading sequence of the Keyway Trigger System during operation thereof, FIG. 22 illustrates a bottom view of a full engagement of a properly loaded dry fire prevention nocked arrow to a crossbow string, with nock pushed all the way back into the trigger assembly thereby making full engagement with the string; FIG. 23 shows a side view of the dry fire prevention nock pushed all the way rearwardly into the trigger assembly making full engagement with the crossbow string without leaving a gap between the nock groove and the string; FIG. 24 illustrates a safe/fire lever 52 formed with bearing track 148 comprised of a first detent and a second detent formed in a bottom i.e. housing-facing surface of the safety lever 52 and associated ball bearing 148A which is received in a bearing seat depression 46 formed in the flat inner surface of the main body housing; FIG. 25 illustrates a left side view and a right side view showing a housing-facing surface of the safety lever actuating link 58 and post 184. The pivot axis of the safe/fire lever, trigger latch and anti-dry fire lever is located on the perpendicular to the central, longitudinal axis of the crossbow, as further described herein. Unless otherwise specifically noted, components depicted in the drawings are not necessarily drawn to scale. For purposes of clarity, the spaces between components are not to scale but enlarged to better illustrate the operation of the system.

The present invention in accordance with the disclosure provides a system for preventing dry fire and partial dry fire of crossbows in the field of crossbow archery. In broad embodiment, the present invention as recited in the claims is directed to a dry fire prevention nock and a trigger assembly for a Keyway Trigger System that is mounted in a crossbow stock and provides for dry fire prevention. The advantages of the present system include, without limitation, elimination of the risk of dry fire and partial dry fire and improved accuracy and reliability of arrows that are shot or fired from crossbows. The dry fire prevention nock and Keyway Trigger System will now be described in detail, with reference made to FIGS. 1-25.

Figure 4:
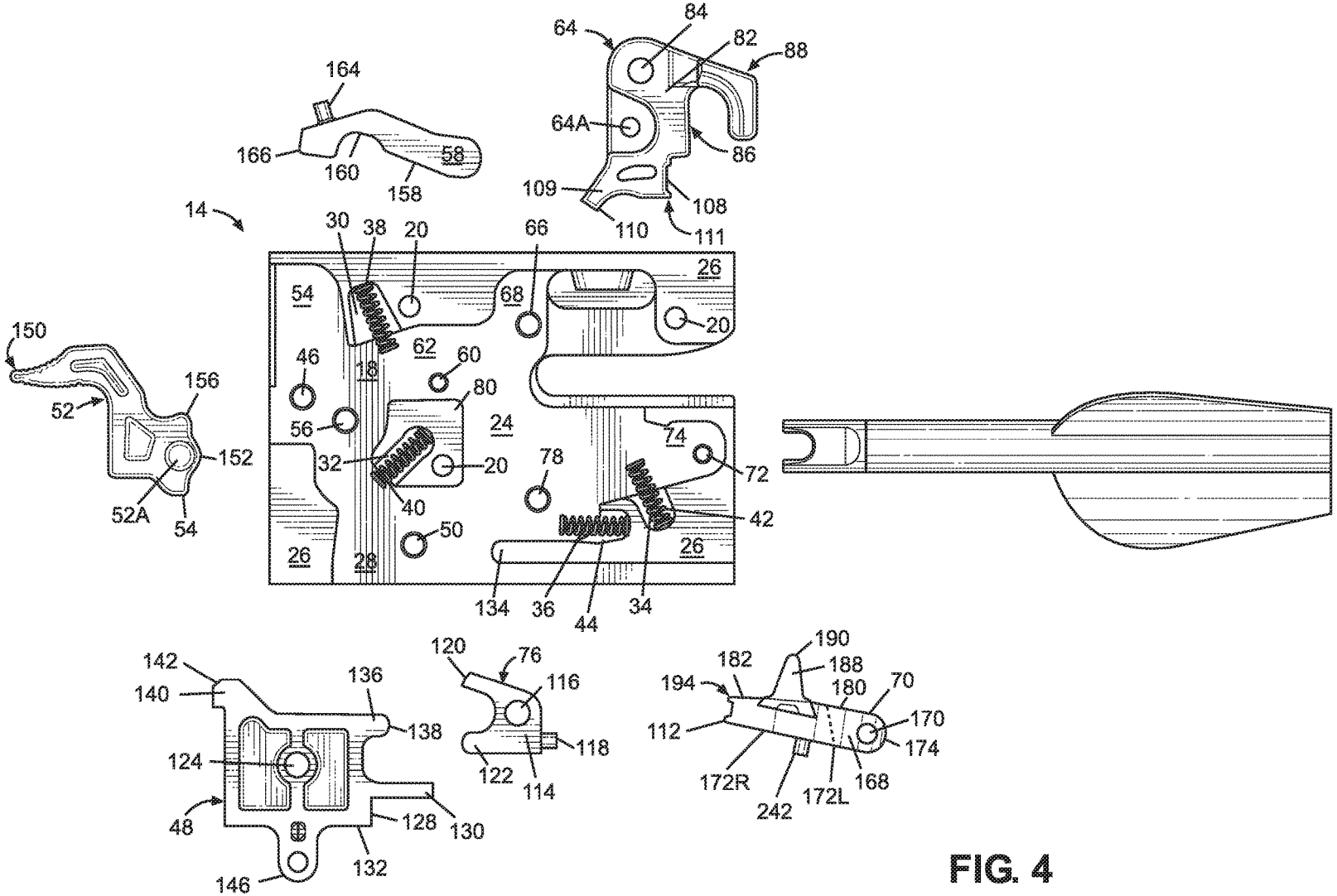
FIG. 4 is an exploded view of trigger assembly showing inner surface of main body of housing.
Figure 5:
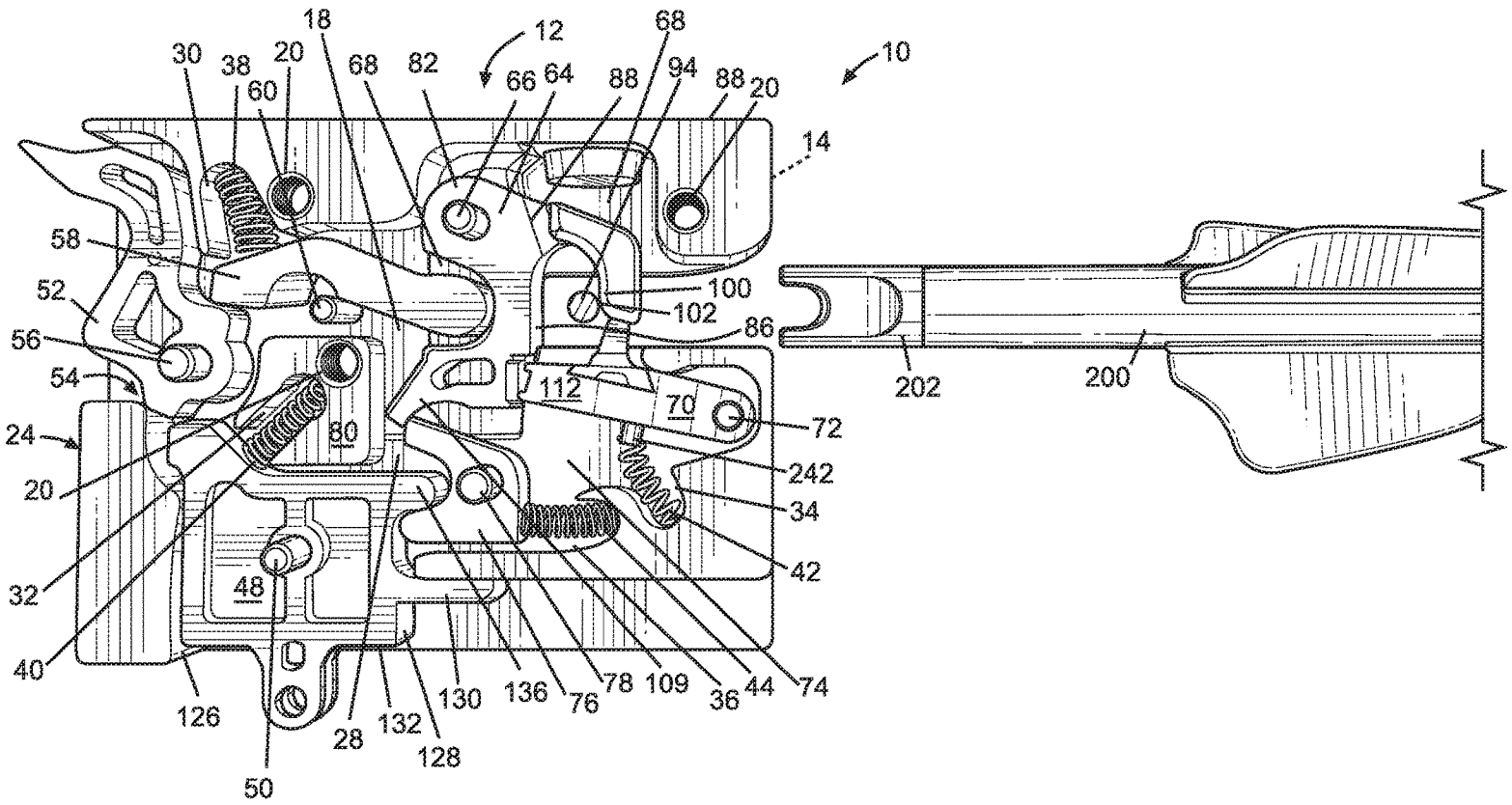
FIG. 5 is a side view of a trigger housing and dry fire preventing arrow nock design in a cocked and unloaded position.
Figure 8:
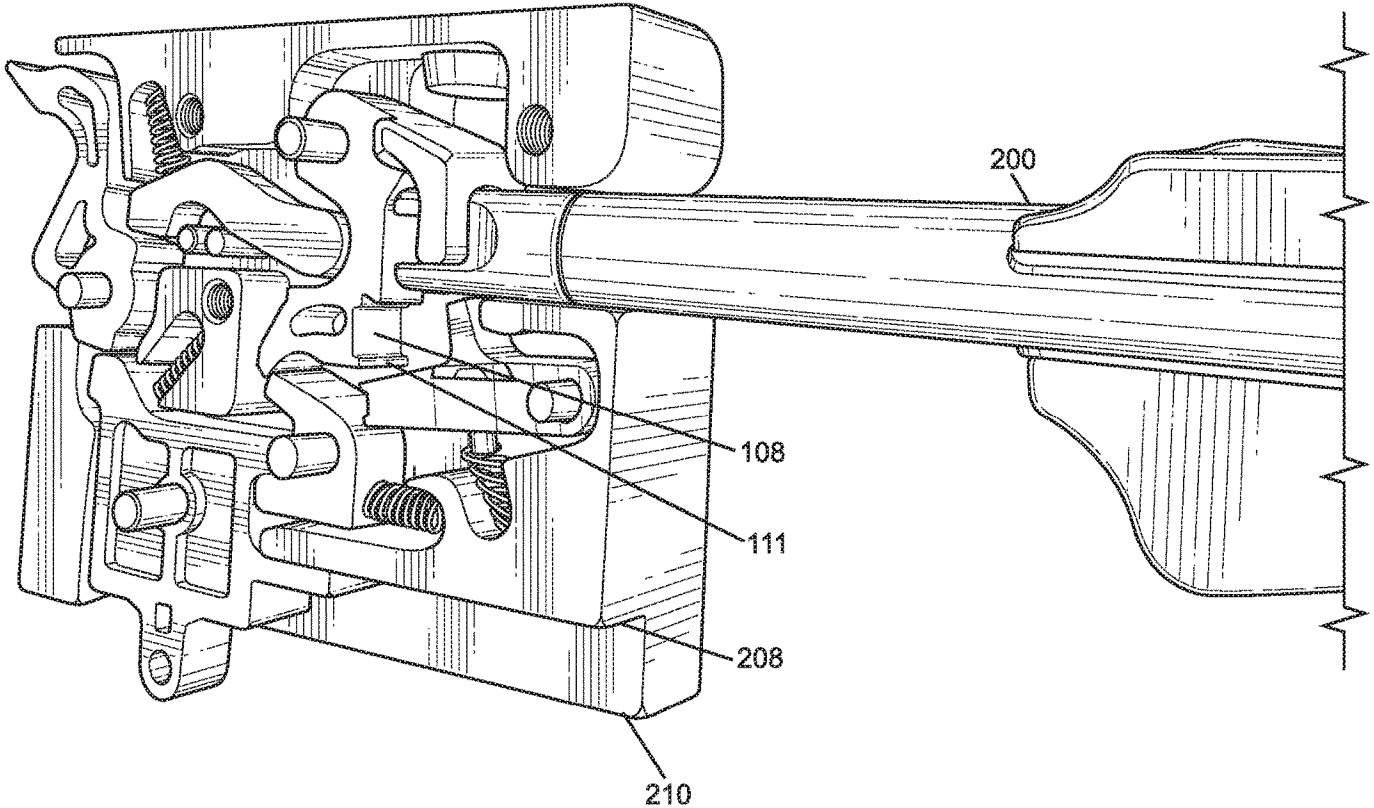
FIG. 8 is a front side perspective interior view illustrating a full insertion of a dry fire prevention nock inserted into a trigger assembly of a Keyway Trigger System opening.
Figure 9:
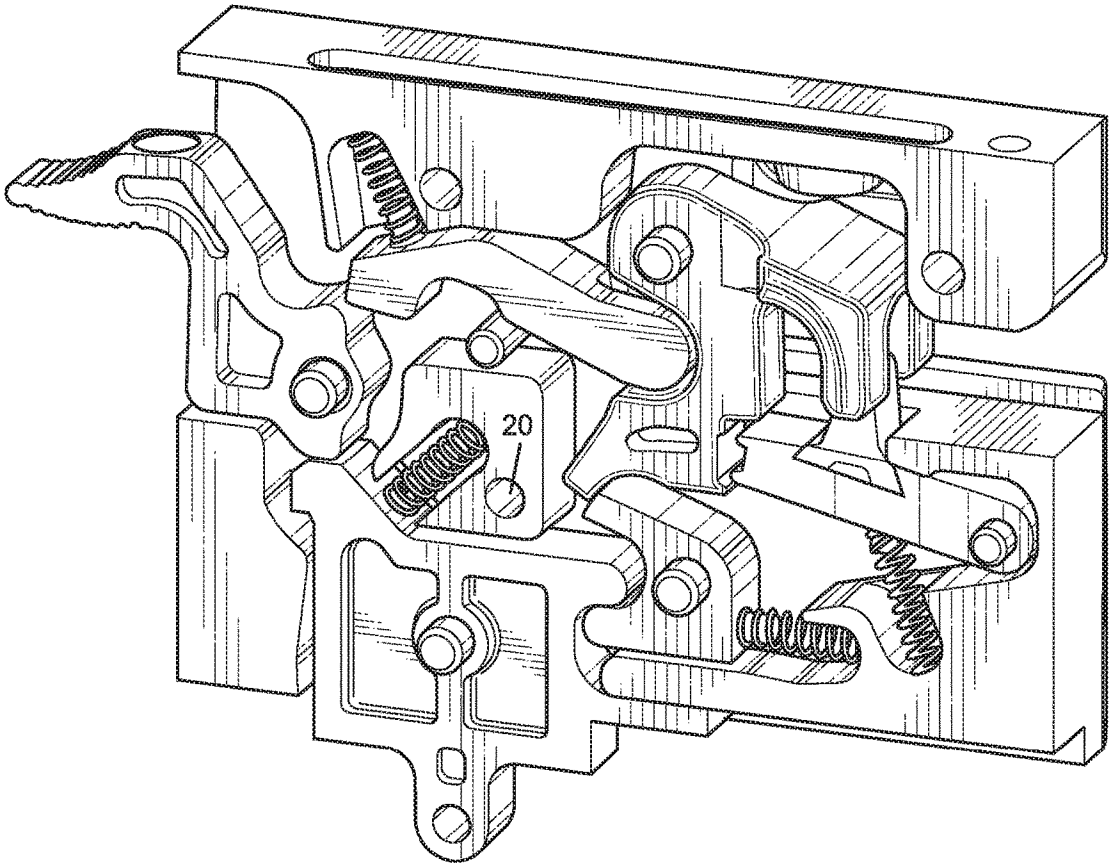
FIG. 9 is a perspective view of a trigger system assembly of a Keyway Trigger System with a threaded aperture located in a lower portion of a main body island in accordance with an embodiment of the present disclosure.
Figure 10:
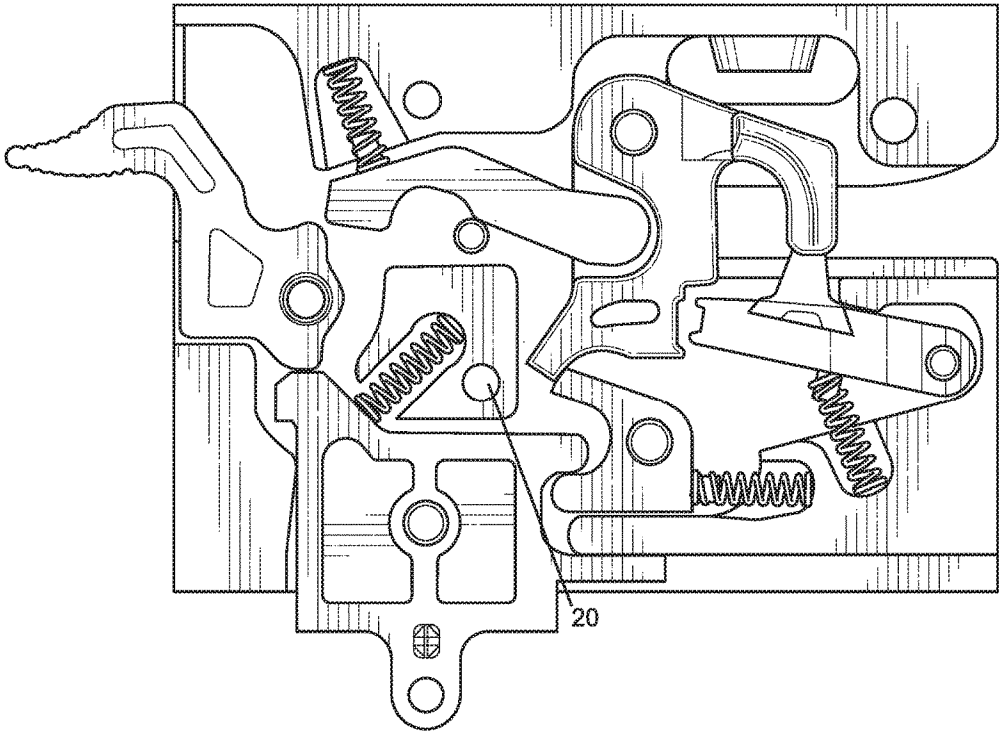
FIG. 10 is a side view of a trigger system assembly of a Keyway Trigger System with a threaded aperture located in a lower portion of a main body island in accordance with an embodiment of the present disclosure.
Figure 12:
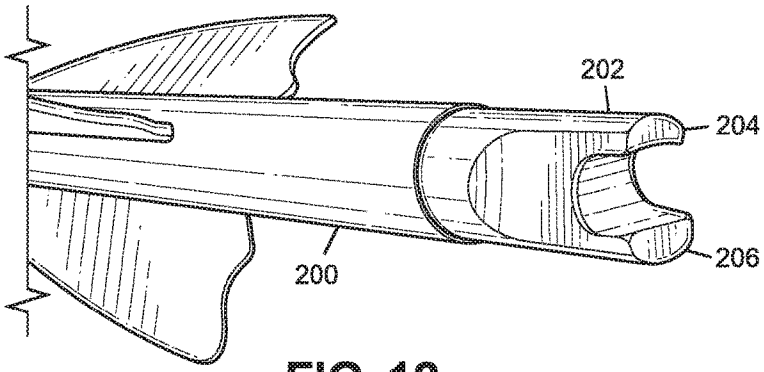
FIG. 12 is a side end perspective view of an arrow nock assembly including a profiled dry fire prevention nock in accordance with an embodiment of the present disclosure.

Referring now to FIGS. 1, 2 and 8, the crossbow Keyway Trigger System 10 in accordance with the present disclosure of the invention includes a housing 12 formed as a cast or machined main body 14, in combination with a cover 16 secured to one side of the main body 14 by fasteners (not shown); such as, but not limited to screws threaded into corresponding threaded apertures 20 in the main body of the housing; apertures 22 in the cover receive the fasteners. As shown in FIG. 4, the main body 14 is formed with an inner flat surface 24 and an outer flat surface 26. The main body is also formed with contiguous recessed areas 18 and cavities 30, 32, 34, 36 in which are seated component parts of the trigger mechanism and biasing elements 38, 40, 42, 44 respectively, and rubber bumper 240. The inner flat surfaces 24 form the floor of the recessed areas 18 and cavities 30, 32, 34, 36 and the outer flat surface 26 provides an outer engagement surface for the cover 16.

Figure 3:
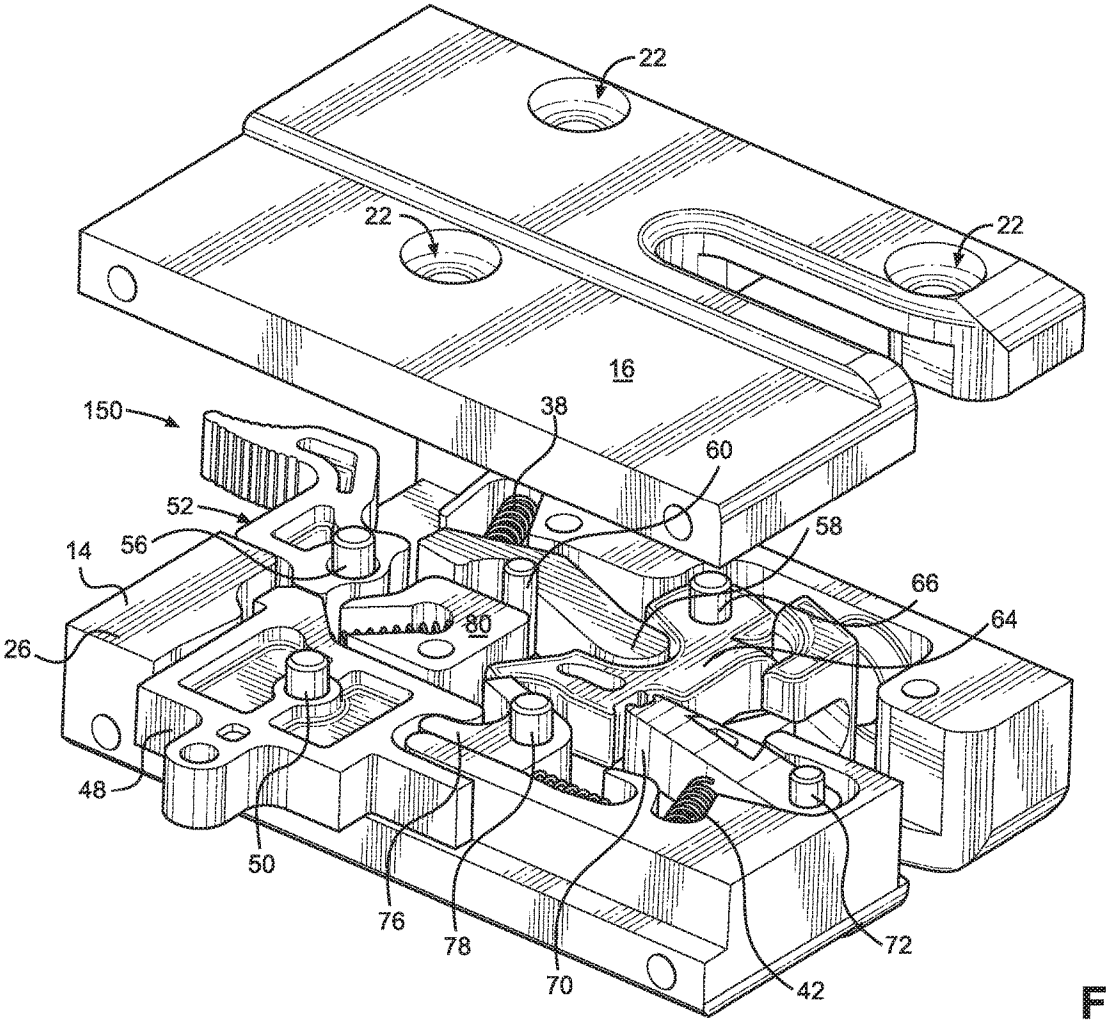
FIG. 3 is a perspective view of a trigger assembly housing main body with cover in an open position to show interior.
Figure 6:
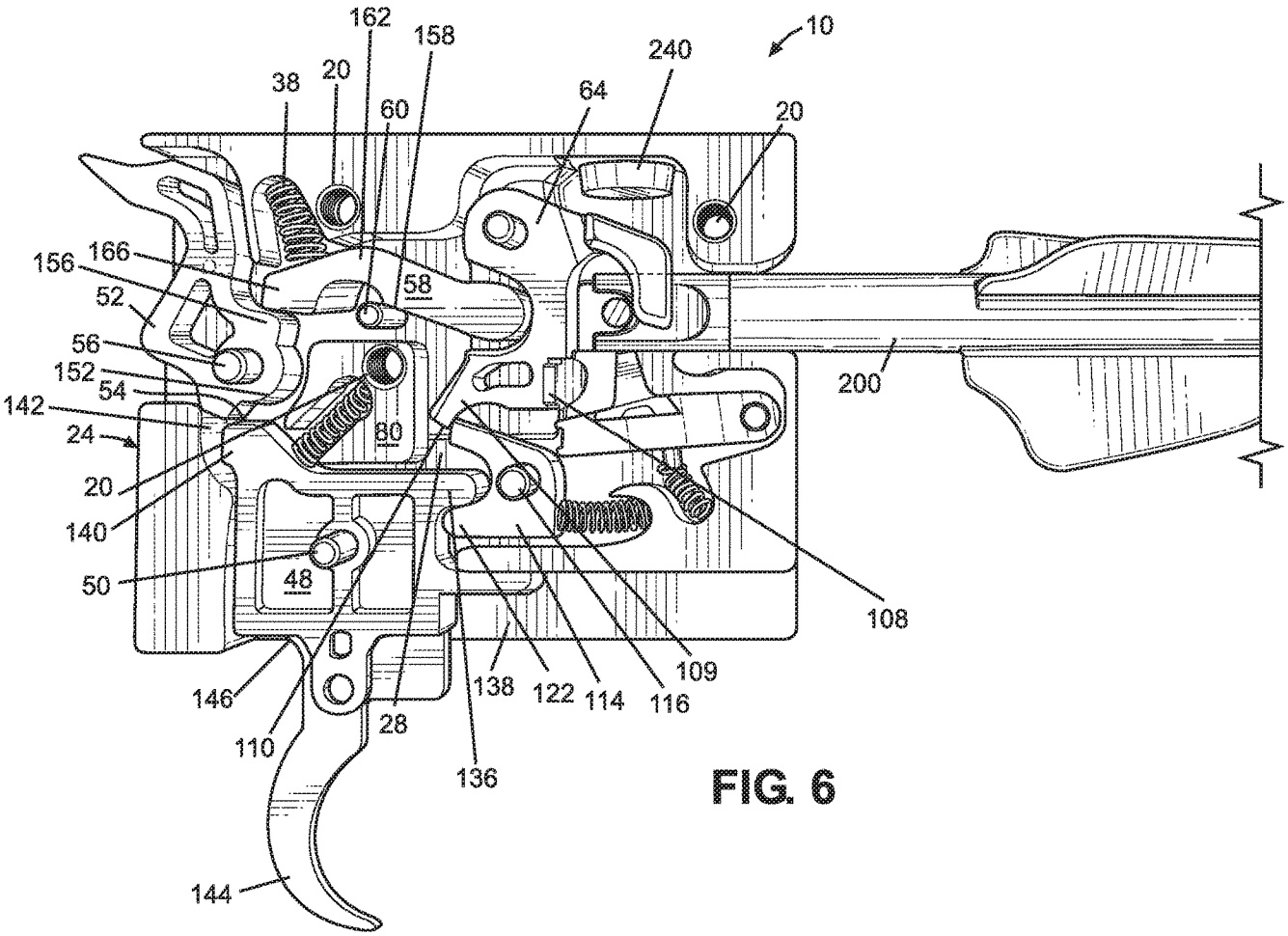
FIG. 6 is a side view of a trigger assembly of a Keyway Trigger System in a cocked and loaded position with an anti-dry fire device disengaged.

As shown in FIGS. 3, 4 and 6, a main recessed area 28 is designed to receive the trigger block 48, pivotably mounted in the housing 12 via pivot pin 50; a safe/fire safety lever 52 pivotably mounted in the housing in recess 54 via pivot pin 56; a safety lever actuating link 58 pivotably mounted in the housing via transverse stop pin 60 within recess 62; a trigger latch 64 pivotably mounted in the housing via pivot pin 66 within recess 68; an anti-dry fire lever 70 pivotably mounted in housing via pivot pin 72 within recess 74; and a sear 76 pivotably mounted in the housing via pivot pin 78. A cavity 30 receives a coil spring 38 that bears on the safety lever actuating link 58. Another cavity 32 formed in an island 80 of the housing receives a coil spring 40 that bears on the trigger block 48. A third cavity 34 receives a coil spring 42 that bears on the anti-dry fire lever 70. A fourth cavity 36 receives a coil spring 44 that bears on the sear 76. In an illustrative representation the fastener-receiving aperture 20 located in island 80 may be positioned as shown in FIGS. 3, 4, 9, and 10, or may be positioned as shown in another illustrative representation as shown in FIGS. 5-8 to thereby secure together the main body 14 and the cover 16 in mating engagement.

Turning now to FIGS. 4-8, the trigger latch 64 includes a center portion 82 formed with a hole 84 for the trigger latch pivot pin 66 and an upper vertical front face 86. A forward extension 88 formed as a yoke includes a pair of downwardly extending crossbow string retaining prongs 90, 92 that are used to retain a crossbow string 94. As best shown in FIGS. 5-9 and 11, each prong 90, 92 includes a forward end face 96, a shoulder surface 98, a rearward end wall surface 100 having a crossbow string-contacting surface 102 used to retain a crossbow string 94, and an inner sidewall surface 104 having a nock side-interfacing surface 106.

Although the preferred embodiment depicted in FIG. 11 includes two prongs, those skilled in the art will understand that the trigger latch mechanism can include, but is not limited to, an apertured prong, a plurality of prongs, prongs arranged in a longitudinal array, a yoke, a caliper, hooks, a metal bar with a catch and lever, catch arms, a blade with an inverted U or V-shaped cut, opening or recess along a lower edge, an apertured cylinder, a ring, a circular band, a slotted disk, a shaped disk, forks, jaws, a jaw with downwardly extending frame portions, a plurality of tines or teeth held together with a crossbeam, crossbar or crosspiece, and a metal bar spanning an opening, or a combination thereof. The trigger latch and various components of the trigger assembly may be installed or mounted to move pivotally, rotatably, and linearly in alternative embodiments. Those of skill in the art will understand that a number of variations may be made in the disclosed embodiments, all without departing from the scope of the invention, which is defined solely be the appended claims.

The term "trigger latch" is used in a functional sense indicating a generally curved structural member. The preferred embodiment employs prongs formed from metal. This material is readily available, and those of skill in the art are familiar with working with such material. Other materials are available that would be suitable for alternative embodiments of the subject matter of the disclosure. Examples include, but are not limited to, metallic materials such as steel, aluminum, stainless steel, titanium, metal composites or alloy, high-density polymers, carbon fiber, resin, plastic or any other similar materials that provide uniform strength and stress distribution throughout the structure. The components of the trigger assembly may be manufactured from any suitable durable, non-brittle material that can withstand exposure to poor hunting weather, extreme temperatures, impact, and forces exerted thereon during repeated firing of the crossbow. Those skilled in the art will understand that any suitable material, now known or hereinafter developed, may be used in forming the trigger latch and other trigger assembly components described herein.

As shown in FIGS. 5-8 and 18-21, during cocking and loading of the crossbow, the rearward end wall surface 100 of each trigger latch prong 90, 92 is adapted and arranged to make full contact with and retain the crossbow string 94. Forward end faces (96, 96) and inner sidewall surfaces (104, 104) of the trigger latch prongs 90, 92 form a radius therebetween. The trigger latch prongs 90, 92 operatively interact with an anti-dry fire nock 202. As a dry fire prevention nock 202 of an arrow 200 is slidably inserted in arrow loading surface area 196 through the radius between the forward end faces (96, 96) and inner side wall surfaces (104, 104) of prongs 90, 92, contact and full engagement with the crossbow string 94 halts the rearward motion of the dry fire prevention nock 202. The trigger latch 64 includes a lower vertical front face 108 having a detainer end portion 111 located thereon. Trigger latch 64 detainer end portion 111 operatively engages the anti-dry fire lever 70, as shown in detail in FIGS. 8 and 18 and further described herein. Detainer end portion 111 further includes downward extension 109 formed as a rearwardly tapering lever with a camming surface 110 that interfaces with the sear 76. As explained further below, the trigger latch 64 is rotatable between a first, closed, crossbow string-retaining position shown in FIGS. 5-6 and 21 and a second, open, crossbow string-releasing position when a user pulls trigger lever 144.

As shown in FIGS. 4-10, the sear component 76 includes a main body 114 formed with a hole 116 for receiving pivot pin 78 and a forwardly projecting protuberance 118 that locates the coil spring 36. A rearward upper lever portion 120 operatively interacts with the trigger latch 64 and a lower lever portion 122 operatively interacts with the trigger block 48 as explained further below.

As shown in FIGS. 4-10, the trigger block 48 is formed with a hole 124 for receiving pivot pin 50. The trigger block 48 projects through an opening 212 formed in the bottom of the housing 12 adjacent to sidewall 126, with a forward face 128 and a forward flange 130 vertically spaced above a lower forward edge 132 of the trigger block 48 and engaging a rearwardly extending flange 134 of the housing 12. The upper edge surface of the trigger block flange 130 engages an external lower edge surface of the housing flange 134. A shorter but parallel forward projection 136 is vertically spaced from the trigger block flange 130 and includes a curved surface 138 that interacts with the lower lever portion 122 of the sear component 76. The trigger block 48 also includes an upwardly extending projection 140 along a rearward edge with an upper, curved surface 142 arranged to operatively interact with the safety lever 52. As shown in FIG. 6, a trigger lever 144 is attached to the trigger block 48 along a lower surface 146 of the trigger block 48 and secured by fasteners (not shown). The trigger lever 144 extends downwardly away from the housing. The term trigger lever is used in a functional sense to indicate a generally curved lever or arm that provided a gripping surface and lever arm to actuate a crossbow trigger assembly to fire an arrow. Those skilled in the art will understand that such suitable triggers include; but are not limited to, lever arms and bull pup triggers.

As shown in FIGS. 4-10 and 26, the safe/fire safety lever 52 includes a rearwardly projecting tab 150 which serves as a handle for the user to move the safety lever between "safe" and "fire" positions a described further herein. A tapered portion forms a forwardly extending curved locking surface 152 rotatable about pin 56 fixed in the housing and includes a downwardly extending curved tapered tab 154 that operatively interacts with the surface 142 of the trigger block 48 while an upwardly extending curved tapered tab 156 operatively interacts with the safety lever actuating link 58 as described further herein.

The safety lever actuating link 58 extends rearwardly from and is operatively connected to the trigger latch 64. As shown in FIGS. 4 and 27, respectively, the trigger latch 64 is formed with a hole 64A; and the safety lever actuating link 58 includes a fixed post 184 provided on the housing-facing surface of the safety lever actuating link 58. Post 184 is received in co-axial alignment through the hole 64A thereby coupling the safety lever actuating link 58 to the trigger latch 64. Safety lever actuating link 58 further includes a tapered surface 158 and a notch 160 formed in curved surface portion 162 operatively interacting with a transverse stop pin 60 fixed in the housing. An upwardly extending protuberance 164 locates the coil spring 38 and a rearwardly extending portion 166 engages the safety lever 52 at an interfacing surface of the upwardly extending curved tapered tab 156.

Figure 18:
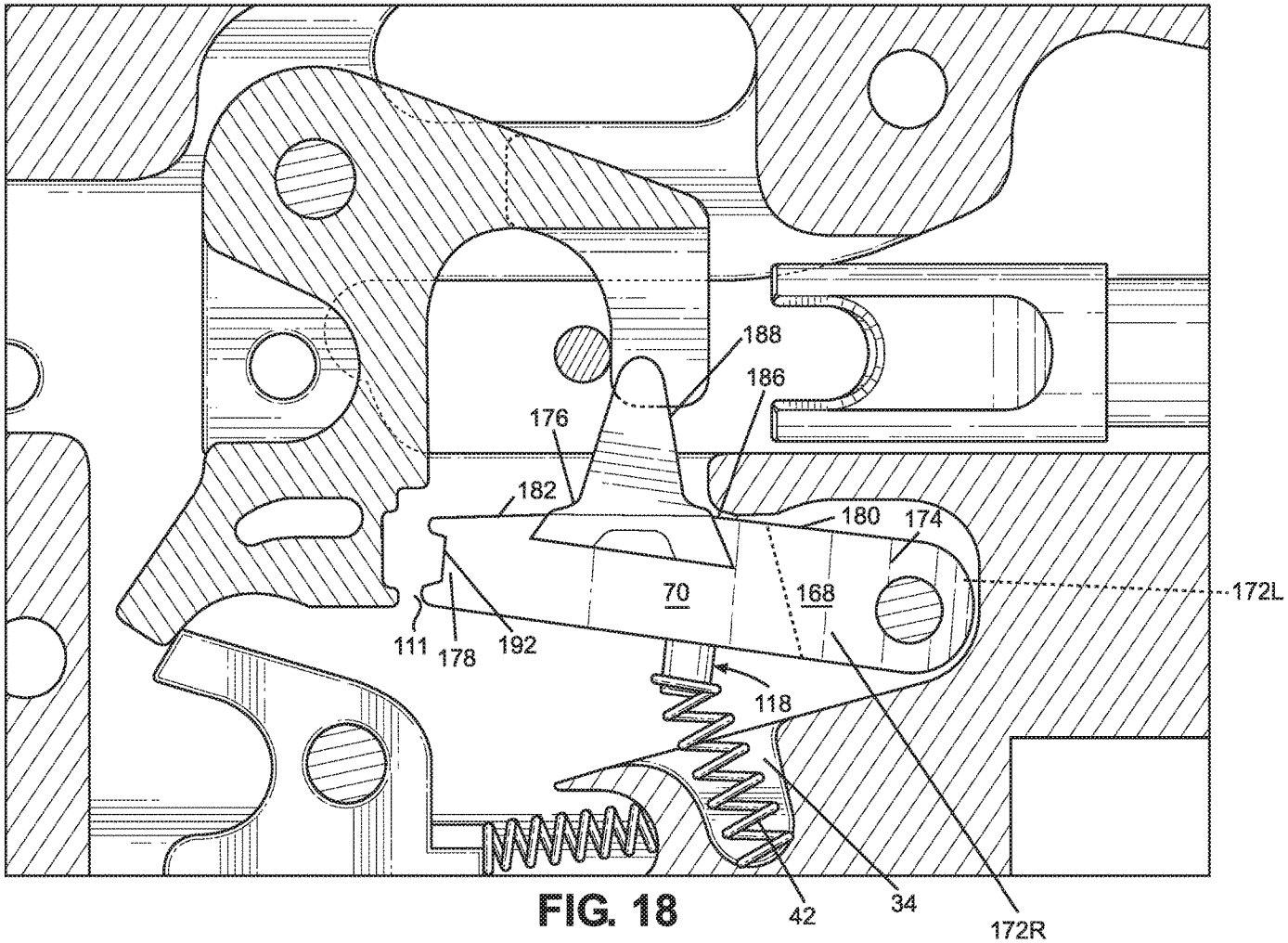
FIG. 18 is a side view illustrating operation of the Keyway Trigger System aligning and engaging sequence in accordance with an embodiment of the present disclosure.
Figure 19:
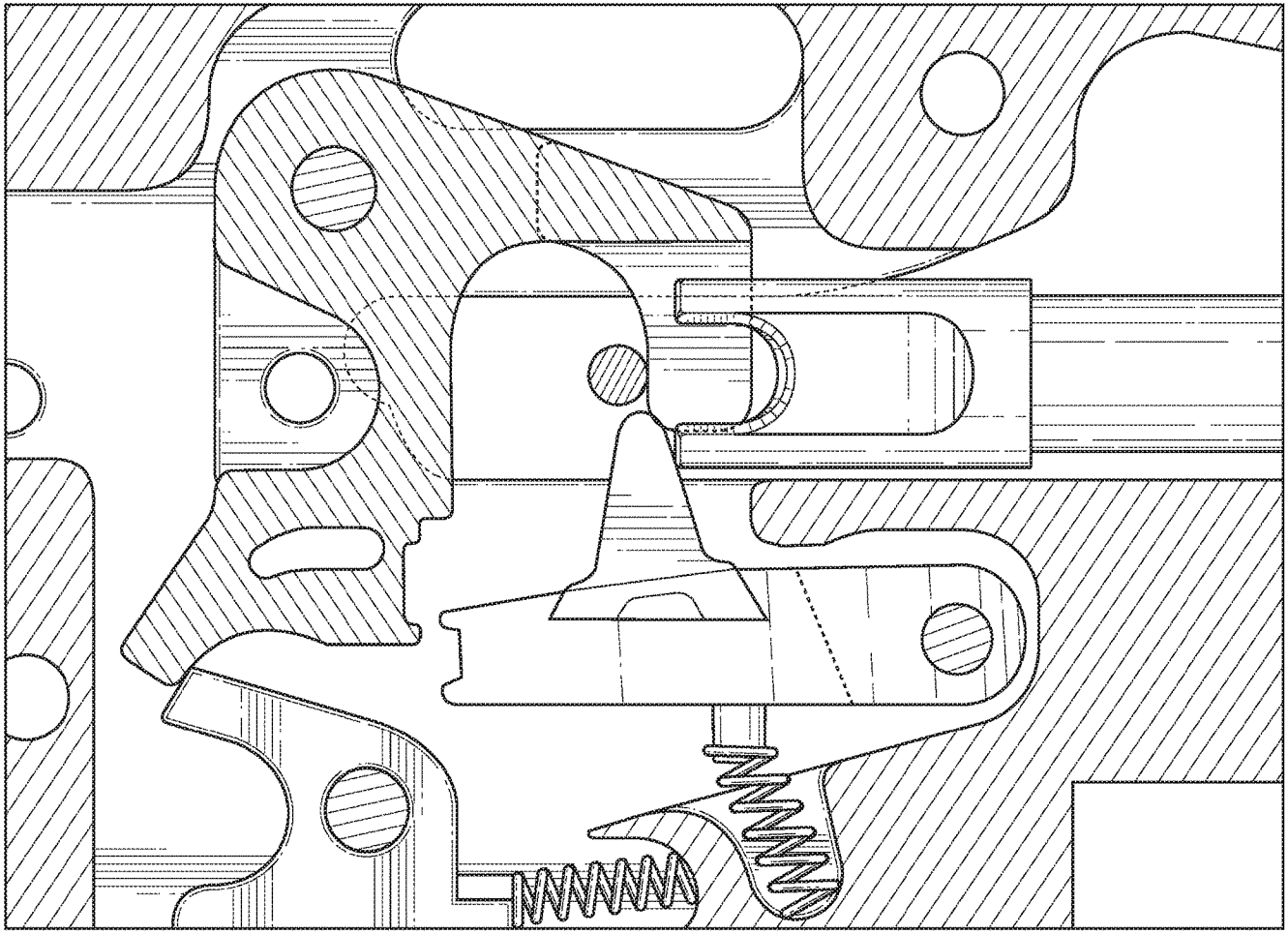
FIG. 19 is a side view illustrating operation of the Keyway Trigger System aligning and engaging sequence in accordance with an embodiment of the present disclosure.
Figure 20:
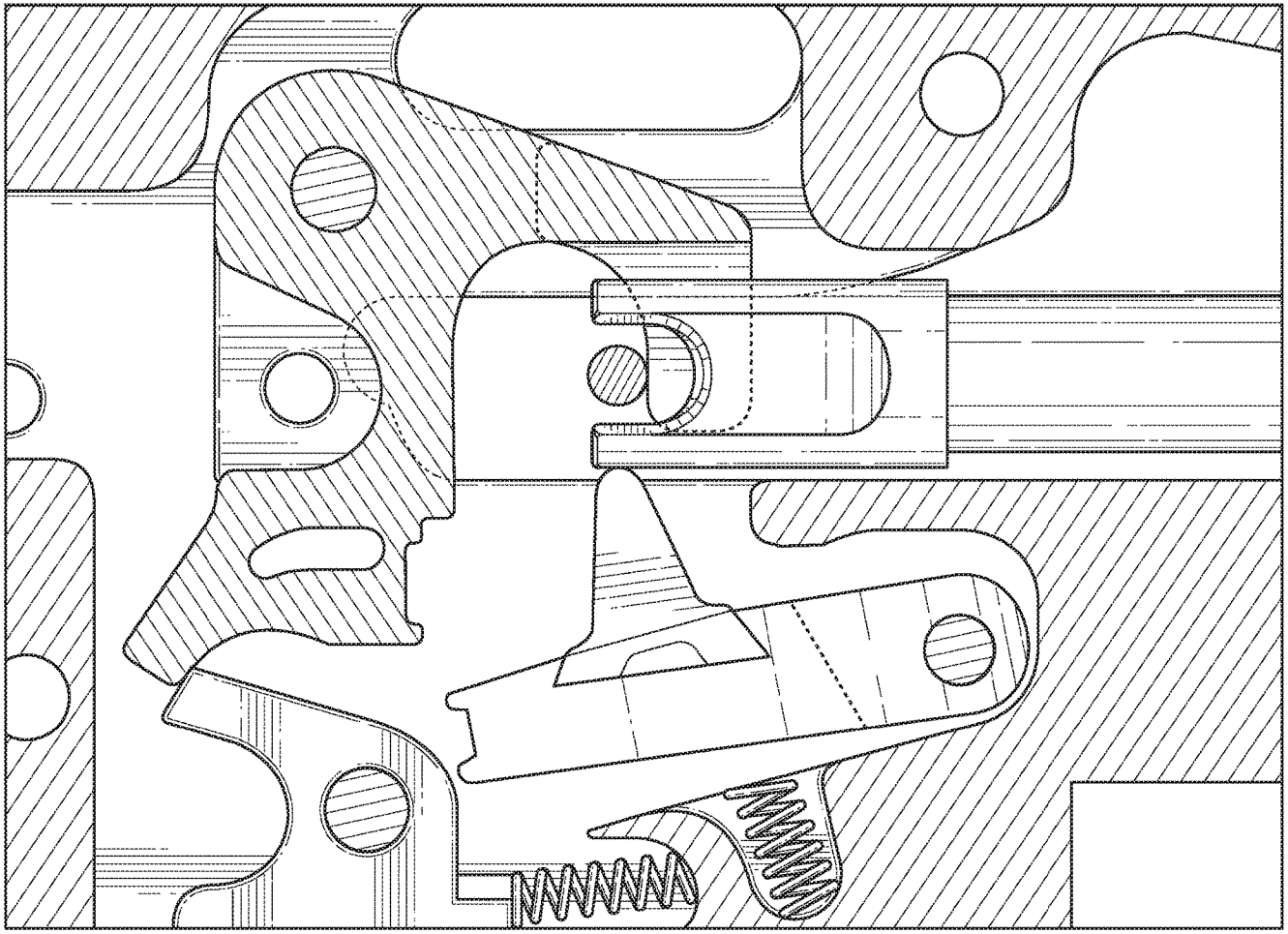
FIG. 20 is a side view illustrating operation of the Keyway Trigger System aligning and engaging sequence in accordance with an embodiment of the present disclosure
Figure 21:
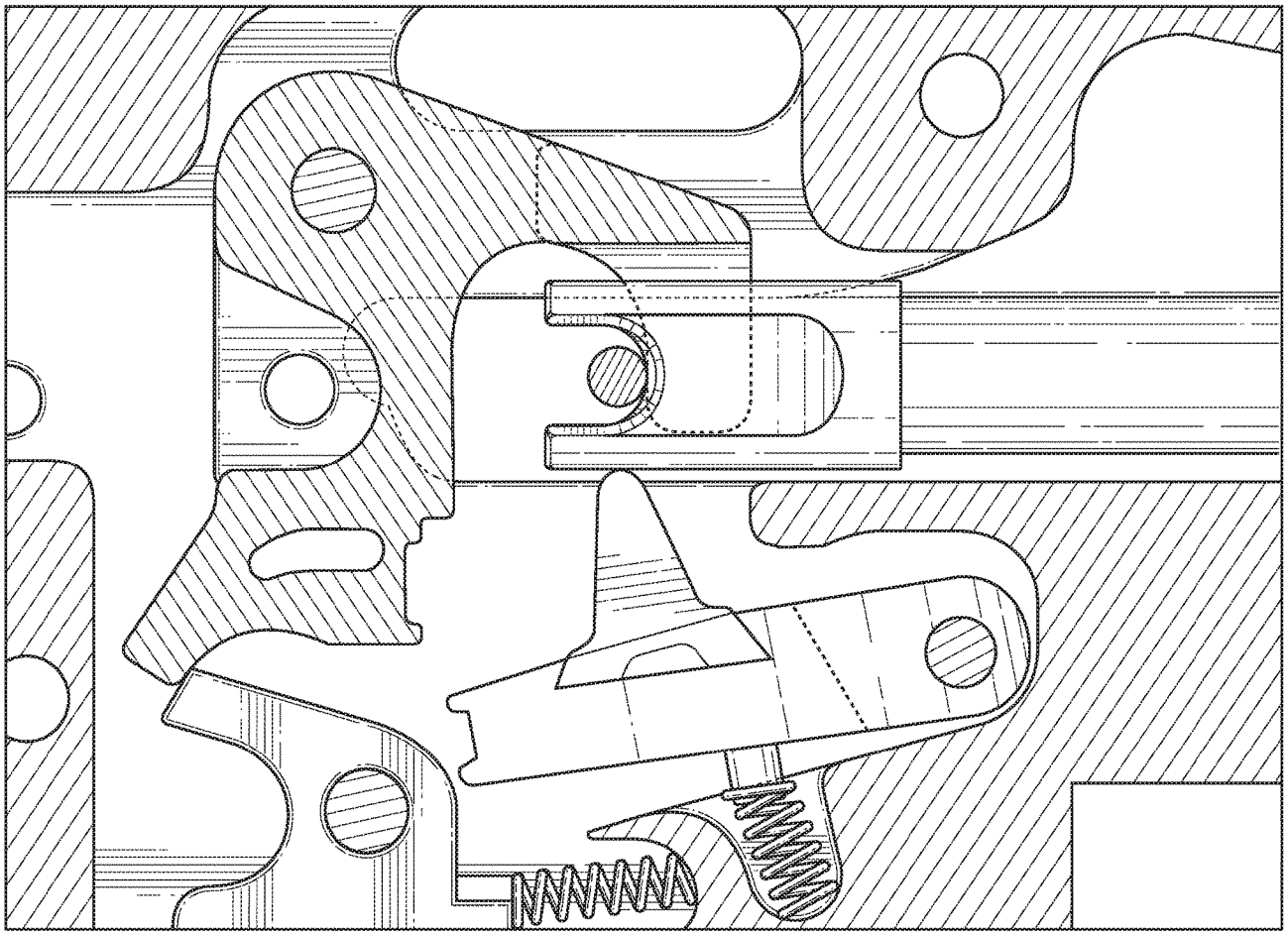
FIG. 21 is a side view illustrating operation of the Keyway Trigger System aligning and engaging sequence in accordance with an embodiment of the present disclosure.

With reference also to FIGS. 4-8 and 18-21, the anti-dry fire lever 70 includes a body 168 formed with a hole 170 at a generally rounded forward end 174 for receiving the pivot pin 72, a flat right side 172R which is a cover-facing surface and a flat left side 172L which is a housing-facing surface as seen from the perspective of the user. The side surfaces (172R, 172L) are symmetrical, accordingly, only a right side surface is shown in the drawings; however, the flat left side 172L is indicated by a dashed reference line in FIGS. 4 and 18. The anti-dry fire lever 70 further includes rounded forward end 174, and an upper surface 176 including oppositely tapered surfaces 180, 182 forming an obtuse angle with a slight apex 186 as best depicted in FIG. 18. As best shown in FIGS. 4 and 18, tapered prong 188 projects upwardly from a position rearward of the apex 186 and includes an upper edge surface portion 190 which forms a nock-engaging surface of tapered prong 188. Turning now to FIGS. 4, 8 and 18, the rearwardly extending portion 112 of the dry fire lever 70 has a square-shaped end portion 178 which includes a vertical notch 192 having an external upper edge surface 194 adapted to operatively engage the trigger latch 64 detainer end 111 portion in a first position, preventing counterclockwise movement of the trigger latch 64 and hence, preventing firing and thereby eliminating the risk of dry fire, partial dry fire and eliminating the risk of damage to the crossbow, fracture and breakage of the crossbow limbs and other components, and reducing the risk of potential injury to the user.

Although the preferred embodiment depicted in FIG. 11 includes an upwardly projecting tapered prong, those skilled in the art will understand that the anti-dry fire lever can include, but is not limited to, an untapered prong, a plurality of prongs, prongs arranged in a longitudinal array, an upwardly extending bar, a blade having a U or V-shaped profile along an upper edge, and a disk, or a combination thereof, arranged either singly or configured as a plurality thereof. The anti-dry fire lever may be installed or mounted to move pivotally, rotatably, and linearly in alternative embodiments. Other materials for fabricating the anti-dry fire lever are available that would be suitable for alternative embodiments of the subject matter of the disclosure. Examples include, but are not limited to, the same or similar materials contemplated above for manufacture of the trigger latch and other components of the trigger assembly. Those of skill in the art will understand that a number of variations may be made in the disclosed embodiments, all without departing from the scope of the invention, which is defined solely be the appended claims.

As shown in FIGS. 4-7, 9-11 and 18, a downwardly projecting protuberance 242 locates the coil spring 42 received in a cavity 34 in the housing 12 main body 14 that biases the anti-dry fire lever 70 in a clockwise direction about the pivot pin 72 such that the upwardly projecting tapered prong 188 protrudes into an arrow loading area surface 196 through a slot 198 formed through a floor of the arrow track loading area surface 196. In a first, non-firing, starting position the tapered prong 188 is aligned with the downwardly extending prongs 90, 92 and in a second, firing, final position the tapered prong 188 is in a position located behind and below the crossbow string 94 and below the downwardly extending crossbow string catch prongs 90, 92 of the trigger latch 64. The end portion edge 178 of the rearwardly extending portion 112 of the anti-dry fire lever 70 operatively interacts with the lower vertical face 108 of the trigger latch 64 to prevent firing in this first position, thereby preventing counterclockwise movement of the trigger latch and hence, preventing firing.

The upwardly projecting tapered prong 188 is formed with a forward taper to facilitate loading of an arrow 200 into the trigger latch in a rearward, loading direction. As shown in FIGS. 5-6, 12 and 18-21, when an arrow 200 having a dry fire prevention nock 202 in accordance with the present disclosure is loaded into the crossbow, wings 204, 206 of the nock 202 pushes the upwardly extending tapered prong 188 of the anti-dry fire lever 70 downwardly through the floor slot 198 to a position below the arrow loading area 196; the anti-dry fire lever 70 is forced to pivot in a counterclockwise direction about the pin 72 such that the rearwardly extending anti-dry fire dry fire lever end portion 178 at its external upper edge surface 194 moves to a position located below the lower vertical front face 108 of the trigger latch 64 which is a disengaged position so that the trigger latch 64 pivots in a counterclockwise direction when the trigger lever 144 is pulled.

Figure 7:
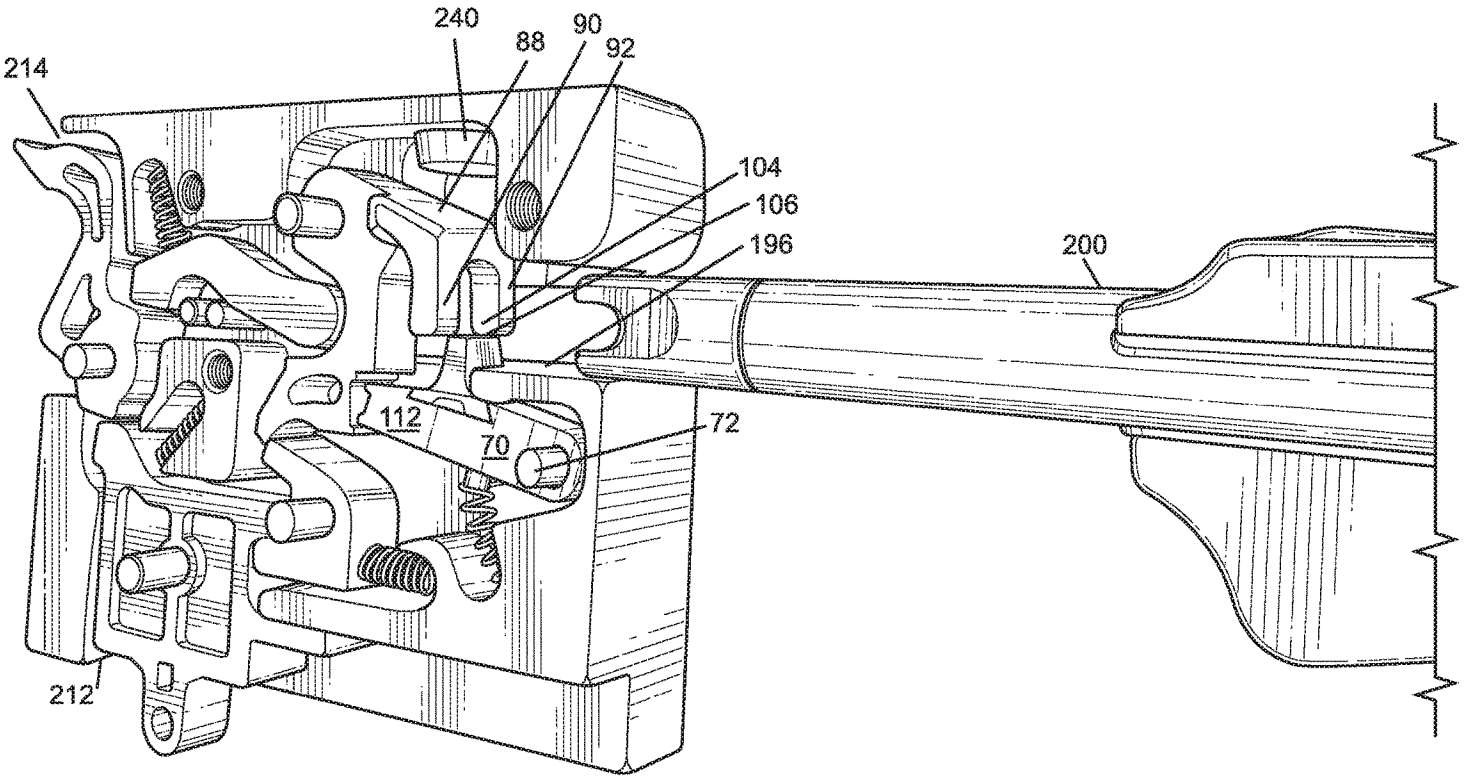
FIG. 7 is a front side perspective interior view illustrating a partial insertion of a dry fire prevention nock into a trigger assembly of a Keyway Trigger System opening.

As shown in FIG. 11, the housing 12 main body 14 is formed with an internal lower edge surface 208 and an external lower edge surface 210 vertically spaced from the internal lower edge surface 208 of the housing. As shown in FIG. 7, the housing 12 main body 14 and cover 16 secured together form an opening 212 in the internal lower edge surface 208 for the trigger block 48, a rearward opening 214 for the safety lever tab 150 and a slot 198, as shown in FIG. 11, through the arrow loading floor 196 for the upwardly extending tapered prong 188. The cover 16 is adapted and arranged to be secured to the housing 12 main body 14 with a lower edge surface 216 that may be formed flush with the internal lower edge surface 208 of the housing 12 main body 14 as shown in a representative embodiment in FIG. 11 or may extend downwardly below the main body 14 lower edge as shown in a representative embodiment in FIG. 2. The cover 16 is secured at apertures 22 therethrough aligned with blind bores 20 in the housing main body 14 thereby providing an inner engagement surface for the cover that also receives the various pivot pins 50, 56, 66, 72, 78, as well as transverse stop pin 60 that mounts the components as described above.

With reference to FIG. 11, a keyway opening 218 is formed by, in combination, the downwardly extending prongs 90, 92 of the trigger latch 64 and the upwardly projecting tapered prong 188 of the anti-dry fire lever 70. The inner sidewall surfaces 104 of the trigger latch prongs 90, 92 form nock-interfacing side walls of a slot and the upper edge surface portion 190 of the upwardly projecting tapered prong 188 forms a moveable floor of the slot thus forming the keyway opening 218. The keyway opening 218 is configured to receive the dry fire prevention nock 202 slidably inserted rearwardly in a loading direction to a full extent through the arrow loading area of the crossbow trigger mechanism such that the wings 204, 206 of the nock extend to a position located behind the crossbow string 94. Only when the dry fire prevention nock is fully engaged with the crossbow string the tapered prong 188 pivots downwardly counterclockwise to a position that permits the trigger latch 64 to release string 94.

As shown in FIGS. 12-17, the profiled dry fire prevention nock 202 embodying features of the present invention include a nock body 220 formed with a first, forwardly extending cylindrical portion 222 having a first diameter D1 sized and shaped to be affixed to a rear end of an arrow 200 and a second, rearwardly extending portion 224 extending laterally from the first cylindrical portion 222 and terminating at a U-shaped opening 226 forming a crossbow string-receiving groove 238 adapted and arranged to receive a crossbow string 94 therein. The second portion 224 further includes an intermediate portion 228 formed with a second diameter D2, a shoulder portion 230 formed with a continuously variable diameter D3 and a back end portion 232 formed by the U-shaped crossbow string-receiving opening 94 and the two wings 204, 206 and having a fourth diameter D4. The shoulder portion 230 is tapered and has a cross sectional diameter D3 that varies from a value that is approximately equal to the diameter D2 of the intermediate portion 228 to a value that is approximately equal to the diameter D4 of the back end portion 232. The second portion 224 is formed with a curved top side 234T, a curved bottom side 234B, a flat right side 236R, indicated by dashed reference line in FIG. 14, and a flat left side 236L, and the flat right side and flat left side are parallel. The top side and the bottom side are identical, i.e. a mirror image of each other; and the right side and the left side are identical, i.e. a mirror image of each other. Accordingly, only a bottom view and a right side view are shown in the Drawings.

The intermediate portion 228 extends rearwardly from the rearward end of the front portion 222 to the shoulder portion 230 of the dry fire prevention nock 202. The two wings 204, 206 are spaced apart and extend substantially parallel from opposite sides of the back end of the intermediate portion 228, forming, in combination with the back end 224 the U-shaped opening 226 sized and shaped to receive a crossbow string 94 with the spacing between the two wings 204, 206 greater than the diameter of the crossbow string 94. The wings 204, 206 of the dry fire prevention nock 202 extend rearwardly past the crossbow string so that as the dry fire prevention nock 202 is slidingly inserted into the trigger assembly keyway opening 218 into full engagement with the crossbow string 94 the anti-dry fire lever 70 tapered prong 188 is moved downwardly to a position behind the crossbow string 94. The nock shoulder, sides and bottom portions are formed with prong-interfacing surfaces that are adapted and arranged to operatively interact with the trigger latch prongs 90, 92 and the anti-dry fire tapered prong 188, respectively. The second portion 224 of the dry fire prevention nock 202 forms a profile P composed of the U-shaped crossbow string receiving opening 226, the flat right side 236R, the flat left side 236L, the curved top side 234T and the curved bottom side 234B. The profile P allows the dry fire prevention nock 202 to pass through the keyway opening 218 of the Keyway Trigger System 10 and causes the groove 238 of the U-shaped crossbow string-receiving opening 226 to seat against the crossbow string 94 and bias the crossbow string 94 into a full and proper engagement with the dry fire prevention nock 202 thereby allowing firing.

Those skilled in the art will appreciate that the Keyway Trigger System 10 in accordance with the present disclosure has a trigger assembly with an slotted opening forming a keyway that prevents conventional arrow nocks from entering the trigger latch to engage the anti-dry fire mechanism so that when the anti-dry fire is not engaged, then the crossbow will not fire thus eliminating the risk of dry fire and partial dry fire, thereby preventing damage to the crossbow and fracture and breakage of the crossbow limbs and other components, and reducing the risk of potential injury to the user.

Materials for the main body portion or the base portion of the dry fire prevention nock may comprise materials generally known in the field of bolt and arrow nocks, such as, by way of non-limiting example, polymeric compositions, plastic, thermoplastics, thermoplastic elastomers, nylon, urethane, rubber materials, wood, composite wood, carbon fiber and aluminum, or any combination thereof. The components may be fabricated from materials having suitable properties or characteristics including materials that are durable, impact-resistant and resilient. The nock may be lighted or unlighted.

The operation of the above described Keyway Trigger System 10 will now be explained in detail. Turning first to FIGS. 3-10 and 18-21, the trigger components of the crossbow trigger during use of the Keyway Trigger System 10 operate such that when the trigger latch 64 is in an open position and the safe/fire safety lever 52 is in the "fire" position, specifically with its rearwardly projecting handle tab 150 rotated upwardly in a clockwise direction about its pin 56 so that safety lever lower edge trigger locking tab 154 is disengaged from upper 140 edge surface 142 of the trigger block 48. Trigger lever 144 is in a normal pre-firing position. The coil spring 40 normally maintains the trigger block 48 and associated trigger lever 144 in the ready-to-fire position, i.e. biased in a counterclockwise direction about the pivot pin 50.

As the crossbow string 94 is pulled rearwardly in a cocking direction, the crossbow string 94 engages the trigger latch 64 causing the trigger latch 64 to move in a clockwise direction about the pivot pin 66. This pivoting action of the trigger latch moves its rearward extension 109 rearwardly such that its camming surface 110 interacts with the sear 76, noting that coil spring 36 normally biases the sear 76 in a clockwise direction about the pivot pin 75. Clockwise movement of the trigger latch 64 also causes the safety lever actuating link 58 to move rearwardly so that the rearward end portion 166 engages the upper tapered tab 156 of the safety lever 52, thus causing the safety lever 52 to pivot in a counterclockwise direction about the pivot pin 56 to the "safe" or locking position where the safety lever 52 lower trigger locking tab 154 prevents any pivoting movement of the trigger block 48 and hence, prevents firing. The anti-dry fire lever 70 is positioned such that the rearwardly extending anti-dry fire lever end 112 is stopped by the lower vertical front face 108 of the trigger latch detainer end 111 portion of the trigger latch 64, thereby preventing any movement of the trigger latch 64 to an open or crossbow string releasing position.

When an arrow 200 having a dry fire prevention nock 202 in accordance with the instant disclosure is slideably loaded into the Keyway Trigger System 10 of a crossbow, the arrow 200 rests on the arrow loading surface 196 of the housing 14 and the dry fire prevention nock 202 is adapted and arranged to operate the trigger latch 64 and anti-dry fire lever 70 in the Keyway Trigger System 10. The flat right side 236R and flat left side 236L of the dry fire prevention nock 202 are prevented from moving further by the string 94 or by the radius between the front end wall surfaces 96 and inner side edge surfaces 104 the downwardly extending prongs 90, 92 of the trigger latch 64, the shoulder side portions 230 of the dry fire prevention nock 202 operatively interfaces with and engages the front end wall surfaces 96 of the downwardly extending prongs 90, 92 and the curved bottom surface 234B of the dry fire prevention nock 202 operatively interfaces with and engages the upper edge surface 190 of the upwardly extending tapered prong 188 causing the prong 188 to move from a position at a location substantially aligned in parallel with prongs 90, 92 to a position located behind and below the crossbow string and hence, causing the anti-dry fire lever 70 to pivot in a counterclockwise direction about pin 72 such that the end portion edge 178 of the rearwardly extending portion 112 of the anti-dry fire lever 70 moves to a location below the lower vertical front face 108 of the trigger latch 64 so that the trigger latch 64 pivots in a counterclockwise direction to a firing position as the trigger 144 is pulled and the trigger latch 64 is free to move to the crossbow string release position when the trigger 144 is pulled. The user may now manually rotate the safe/fire safety lever 52 by pushing handle tab 150 in a clockwise direction about the pivot pin 56 to disengage the safety lever lower locking tab 154 from the upper surface of the trigger block 48 thus freeing up the trigger assembly of the Keyway Trigger System 10 and permitting the trigger lever 144 to be pulled for firing the arrow.

The user may now fire the arrow 200 by pulling the trigger 144 thereby drawing the trigger block 48 downward in a clockwise direction about pivot pin 50. The curved surface 138 of the trigger block 48 operatively interfaces with and engages the lower lever portion 122 of the sear 76, causing the sear 76 to move in a counterclockwise direction about the pivot pin 78. Simultaneously, the rearward upper lever portion 120 also moves in a counterclockwise direction, allowing the camming surface 110 of the trigger latch 64 to move forward in a counterclockwise direction such that the tension in the crossbow string 94 is free to act on the downwardly extending prongs 90, 92 of the trigger latch 64 to pivot the trigger latch 64 in a counterclockwise direction about the pivot pin 66, thus releasing the crossbow string 94 and firing the arrow 200.

The safe/fire safety lever 52 can be in the "safe" or "fire" position as the crossbow string 94 is drawn and cocked; however, if the safety lever 52 is in the "fire" position it will be automatically moved to the "safe" position during cocking. If the safety lever 52 is already in the "safe" position during cocking, the remaining components of the trigger mechanism act in the same manner as described above.

The Keyway Trigger System 10 requires that the dry fire prevention nock 202 is adapted and arranged to be slidingly inserted rearwardly into the keyway opening 218 to a full extent so that the nock wings 204, 206 extend behind the crossbow string 94, the groove 238 of the string receiving opening 226 is aligned with the rearward end edges 100 of the trigger latch prongs 90, 92 the flat sides 236R, 236L of the dry fire prevention nock 202 engage the trigger latch 64 prongs 90, 92 inner side edges 104 and the shoulder 230 of the dry fire prevention nock 202 contacts the string 94 then abuts then the front end faces 96 of the trigger latch 64 prongs 90, 92. The upwardly extending tapered prong 188 is in parallel alignment with the downwardly extending prongs of the trigger latch in the starting non-firing position and in the final firing position the tapered prong 188 is in a position located behind and below the crossbow string 94.

When this alignment is attained then the dry fire prevention nock 202 crossbow string receiving opening 226 is properly seated and fully engaged with the crossbow string 94. As the nock 202 makes full engagement with the crossbow string 94 and the groove 238 of the U-shaped crossbow string-receiving opening 226 is aligned with the rear end wall edges 100 of the string catch prongs 90, 92 the curved bottom surface 236B of the dry fire prevention nock 202 interacts with and causes the upwardly extending tapered prong 188 of the anti-dry fire lever 70 to move downwardly out of the arrow loading area 196 behind and below the downwardly extending prongs 90, 92 and behind and below the crossbow string 94. This causes the rearwardly extending portion 112 of the anti-dry fire lever 70 anti-dry fire lever end portion edge 178 to pivot counterclockwise downwardly below the lower vertical front face 108 of the trigger latch 64.

After a user loads the arrow, the user manipulates the safe/fire safety lever 52 manually to disengage the safety lever 52 from the trigger block 48 so that the trigger 144 can be pulled by the user to fire the arrow 200.

Arrows having the dry fire prevention nocks of the present disclosure may be shot or fired from the crossbow by cocking the crossbow and positioning the center of the crossbow string toward the rear end of the crossbow, thereby flexing the limbs of the bow rearwardly or inwardly, loading an arrow with the nock indexed correctly by slidably inserting the dry fire prevention nock rearward into the keyway opening of the Keyway Trigger System thereby disengaging the anti-dry fire system, and pulling the trigger of the trigger assembly. The trigger cause the crossbow string to be released, thereby allowing the tension in the limbs to forcefully straighten the crossbow string and move the center of the crossbow string toward the front end of the crossbow. This movement of the crossbow string causes the crossbow string to push the arrow forward while it contacts the nock and, consequently, launch the arrow. The Keyway Trigger System improves performance by ensuring an arrow is properly loaded into a crossbow, efficiently and properly transferring the energy of the crossbow string to the arrow with maximum propulsive force for straight and true arrow flight, improved shooting performance and effectively eliminating the possibility of dry fire and partial dry fire.

Thus, the Keyway Trigger System of the present invention provides a dry fire prevention nock and anti-dry fire keyway system for alignment and engagement of arrows that are fired from crossbows to effectively eliminate the possibility of dry fire and partial dry fire when an arrow is improperly loaded into a crossbow.

It will be appreciated that the above description relates to a specific embodiment of the invention, provided by way of example only. A number of variations are possible, and would be obvious to those of ordinary skill in the art. Such obvious variations are within the scope of the invention as defined and claimed, whether or not expressly recited. Although specific arrangements are shown in the exemplary embodiment, any suitable structures, linkages or mechanisms can be employed to perform the function recited herein; neither the present disclosure nor the appended claims are limited to the specific arrangements or embodiments shown in the Drawings. It is intended that equivalents of the disclosed exemplary embodiments and methods shall fall within the scope of the present disclosure or appended claims. By way of non-limiting example, some parts that are shown in the exemplary embodiment as rotating can move linearly in alternative embodiments and vice versa, unless the specific type of movement is specified in a given claim. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively unless it is explicitly stated otherwise, e.g. by use of "either . . . or," "only one of," or similar language. For purposes of the present disclosure or appended claims, the words "comprising," "including" "having," and variants thereof, wherever they appear, shall be construed as open-ended terminology, with the same meaning as if the phrase "at least" were appended after each instance thereof.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions, additions, or substitutions of equivalents are contemplated as circumstances may suggest or render expedient without departing from the scope of the disclosure, but is intended to cover the application or implementation without departing from the spirit or scope of the claims of the present invention. The terms "including" and "having" as used in the specification and claims shall have the same meaning as the term "comprising."

The invention claimed is:

1. A system for preventing full and partial dry fires of a crossbow, comprising a crossbow trigger mechanism including:

a trigger housing;

a trigger latch component moveable between a crossbow string retaining position and a crossbow string releasing position;

a trigger assembly mounted in said trigger housing and operatively engaged with said trigger latch component;

an anti-dry fire lever moveable between a first position aligned with said trigger latch component to a second position behind and below a cocked crossbow string;

a keyway opening in said trigger latch component formed by said anti-dry fire lever and a plurality of nock-contacting surfaces within said trigger latch component; and a dry fire prevention nock received in said keyway opening wherein said dry fire prevention nock includes a forward portion for affixing to an arrow and a rearward portion terminating at a pair of spaced, opposed wings forming a U-shaped opening to receive said crossbow string therein and where said wings extend behind said crossbow string when said crossbow string is received in said U-shaped opening therein permitting said dry fire prevention nock to be seated against said crossbow string, causing said anti-dry fire lever to pivot downwardly to said anti-dry fire lever said second position, when said dry fire prevention nock is fully inserted into said keyway opening causing said anti-dry fire lever to move from said first position into said second position thereby releasing said trigger latch to said crossbow string releasing position whereby said crossbow is ready to be fired;

wherein said trigger latch further comprises two downwardly extending trigger latch prongs which include a plurality of nock contacting surfaces;

wherein said anti-dry fire lever includes an upwardly projecting tapered prong:

said upwardly projecting tapered prong includes a nock-contacting upper edge surface; and said first downwardly extending prong and said second downwardly extending prong and said upwardly extending projection forming said keyway opening.

2. The system for preventing full and partial dry fires of a crossbow as claimed in claim 1, further comprising a safety lever mounted in said trigger housing;

said safety lever movable between a first safe position and a second firing position;

said safety lever movable manually into and out of engagement with a trigger block of said trigger assembly; and said trigger block movable between a first non-firing position and a second firing position.

3. A system for preventing full and partial dry fires of a crossbow, comprising:

a crossbow trigger mechanism including:

a trigger housing;

a trigger latch component moveable between a crossbow string retaining position and a crossbow string releasing position;

a trigger assembly mounted in said trigger housing and operatively engaged with said trigger latch component;

an anti-dry fire lever moveable between a first position aligned with said trigger latch component to a second position behind and below a cocked crossbow string;

a keyway opening in said trigger latch component formed by said anti-dry fire lever and a plurality of nock-contacting surfaces within said trigger latch component; and a dry fire prevention nock received in said keyway opening wherein said dry fire prevention nock includes a forward portion for affixing to an arrow and a rearward portion terminating at a pair of spaced, opposed wings forming a U-shaped opening to receive said crossbow string therein and where said wings extend behind said crossbow string when said crossbow string is received in said U-shaped opening therein permitting said dry fire prevention nock to be seated against said crossbow string, causing said anti-dry fire lever to pivot downwardly to said anti-dry fire lever said second position, when said dry fire prevention nock is fully inserted into said keyway opening causing said anti-dry fire lever to move from said first position into said second position thereby releasing said trigger latch to said crossbow string releasing position whereby said crossbow is ready to be fired;

wherein said anti-dry fire lever further comprises:

a first upper edge surface portion to engage a stop of a front vertical face of said trigger latch when no arrow is loaded in the crossbow to prevent movement of said trigger latch to said crossbow string releasing position; and a second upper edge surface portion to engage an arrow nock such that when an arrow nock is loaded into the crossbow, said first upper edge surface portion is moved downwardly away from said stop to permit movement of said trigger latch component to said crossbow string releasing position.

4. A system for preventing full and partial dry fires of a crossbow, comprising:

a crossbow trigger mechanism including:

a trigger housing;

a trigger latch component moveable between a crossbow string retaining position and a crossbow string releasing position;

a trigger assembly mounted in said trigger housing and operatively engaged with said trigger latch component;

an anti-dry fire lever moveable between a first position aligned with said trigger latch component to a second position behind and below a cocked crossbow string;

a keyway opening in said trigger latch component formed by said anti-dry fire lever and a plurality of nock-contacting surfaces within said trigger latch component; and a dry fire prevention nock received in said keyway opening wherein said dry fire prevention nock includes a forward portion for affixing to an arrow and a rearward portion terminating at a pair of spaced, opposed wings forming a U-shaped opening to receive said crossbow string therein and where said wings extend behind said crossbow string when said crossbow string is received in said U-shaped opening therein permitting said dry fire prevention nock to be seated against said crossbow string, causing said anti-dry fire lever to pivot downwardly to said anti-dry fire lever said second position, when said dry fire prevention nock is fully inserted into said keyway opening causing said anti-dry fire lever to move from said first position into said second position thereby releasing said trigger latch to said crossbow string releasing position whereby said crossbow is ready to be fired;

a safety lever mounted in said trigger housing;

said safety lever movable between a first safe position and a second firing position;

said safety lever movable manually into and out of engagement with a trigger block of said trigger assembly;

said trigger block movable between a first non-firing position and a second firing position;

a safety lever actuating link, wherein said safety lever actuating link engages said safety lever to position said safety lever in said first safe position; and a sear movable between a first de-cocked position and a second cocked position, wherein said sear engages said trigger block to position said trigger block in said second firing position.

5. A system for preventing full and partial dry fires of a crossbow, comprising:

a crossbow trigger mechanism including:

a trigger housing;

a trigger latch component moveable between a crossbow string retaining position and a crossbow string releasing position;

a trigger assembly mounted in said trigger housing and operatively engaged with said trigger latch component;

an anti-dry fire lever moveable between a first position aligned with said trigger latch component to a second position behind and below a cocked crossbow string;

a keyway opening in said trigger latch component formed by said anti-dry fire lever and a plurality of nock-contacting surfaces within said trigger latch component; and a dry fire prevention nock received in said keyway opening wherein said dry fire prevention nock includes a forward portion for affixing to an arrow and a rearward portion terminating at a pair of spaced, opposed wings forming a U-shaped opening to receive said crossbow string therein and where said wings extend behind said crossbow string when said crossbow string is received in said U-shaped opening therein permitting said dry fire prevention nock to be seated against said crossbow string, causing said anti-dry fire lever to pivot downwardly to said anti-dry fire lever said second position, when said dry fire prevention nock is fully inserted into said keyway opening causing said anti-dry fire lever to move from said first position into said second position thereby releasing said trigger latch to said crossbow string releasing position whereby said crossbow is ready to be fired;

a safety lever mounted in said trigger housing;

said safety lever movable between a first safe position and a second firing position;

said safety lever movable manually into and out of engagement with a trigger block of said trigger assembly; and said trigger block movable between a first non-firing position and a second firing position;

a safety lever actuating link, wherein said safety lever actuating link engages said safety lever to position said safety lever in said first safe position; and wherein rotation of said trigger latch component into said crossbow string retaining position when said crossbow string is received in said trigger latch causes said safety lever actuating link to move said safety lever into said second firing position.

6. A system for preventing full and partial dry fires of a crossbow, comprising:

a crossbow trigger mechanism including:

a trigger housing;

a trigger latch component moveable between a crossbow string retaining position and a crossbow string releasing position;

a trigger assembly mounted in said trigger housing and operatively engaged with said trigger latch component;

an anti-dry fire lever moveable between a first position aligned with said trigger latch component to a second position behind and below a cocked crossbow string;

a keyway opening in said trigger latch component formed by said anti-dry fire lever and a plurality of nock-contacting surfaces within said trigger latch component; and a dry fire prevention nock received in said keyway opening wherein said dry fire prevention nock includes a forward portion for affixing to an arrow and a rearward portion terminating at a pair of spaced, opposed wings forming a U-shaped opening to receive said crossbow string therein and where said wings extend behind said crossbow string when said crossbow string is received in said U-shaped opening therein permitting said dry fire prevention nock to be seated against said crossbow string, causing said anti-dry fire lever to pivot downwardly to said anti-dry fire lever said second position, when said dry fire prevention nock is fully inserted into said keyway opening causing said anti-dry fire lever to move from said first position into said second position thereby releasing said trigger latch to said crossbow string releasing position whereby said crossbow is ready to be fired; and wherein said dry fire prevention nock has a variable diameter from an intermediate portion to a shoulder portion.

7. The system for preventing full and partial dry fires of a crossbow as claimed in claim 6, wherein said dry fire prevention nock further comprises:

a first portion including a front cylindrical element to be attachably received at a cylindrical aperture located at a rear end of an arrow; and a second portion extending laterally from said first cylindrical portion and terminating at a U-shaped opening, said U-shaped opening to receive a crossbow string therein.

8. The system for preventing full and partial dry fires of a crossbow as claimed in claim 7, wherein said second portion of said dry fire prevention nock includes a flat right side and a flat left side, said flat right side and said flat left side are parallel.

9. The system for preventing full and partial dry fires of a crossbow as claimed in claim 8, wherein said second portion of said dry fire prevention nock has a curved top side and a curved bottom side.

10. The system for preventing full and partial dry fires of a crossbow as claimed in claim 7, wherein said second portion of said dry fire prevention nock is inserted into said keyway opening.

11. The system for preventing full and partial dry fires of a crossbow as claimed in claim 7, wherein said second portion of said dry fire prevention nock has a profile configuration including said U-shaped opening, a flat right side, a flat left side, saga curved top side and a curved bottom side, wherein said profile allows said nock to pass through a keyway opening of said crossbow trigger mechanism.

12. The system for preventing full and partial dry fires of a crossbow as claimed in claim 11, wherein said second portion of said dry fire prevention nock profile configuration allows said U-shaped opening to engage said crossbow string wherein said U-shaped opening of said second portion of said dry fire prevention nock biases said crossbow string into engagement with said dry fire prevention nock.

13. The system for preventing full and partial dry fires of a crossbow as claimed in claim 7, wherein said second portion of said dry fire prevention nock is slidably received in a keyway opening of said crossbow trigger mechanism.

14. The system for preventing full and partial dry fires of a crossbow as claimed in claim 6, comprising:

said crossbow trigger mechanism further comprising:

two downwardly extending trigger latch prongs of said trigger latch component moveable between said crossbow string retaining position and said crossbow string releasing position;

one upwardly extending anti-dry fire prong of said anti-dry fire lever moveable between a first unlocked position and a second locked position;

said one upwardly extending anti-dry fire prong located intermediate to said two downwardly extending trigger latch prongs; and said downwardly extending trigger latch prongs and said upwardly extending anti-dry fire prong form said keyway opening to receive said dry fire prevention nock of said arrow therein.

15. The system for preventing full and partial dry fires of a crossbow as claimed in claim 14, wherein said dry fire prevention nock of said arrow engages said crossbow string at a location behind said two downwardly extending trigger latch prongs and said upwardly extending anti-dry fire prong to cause said anti-dry fire lever to move to said first unlocked position.

* * * * *